US007740488B2

(12) United States Patent
Taylor

(10) Patent No.: US 7,740,488 B2
(45) Date of Patent: Jun. 22, 2010

(54) INTERPOSER ASSEMBLY AND METHOD

(75) Inventor: Paul R. Taylor, Mechanicsburg, PA (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 12/355,168

(22) Filed: Jan. 16, 2009

(65) Prior Publication Data

US 2009/0186495 A1 Jul. 23, 2009

Related U.S. Application Data

(60) Provisional application No. 61/122,048, filed on Dec. 12, 2008, provisional application No. 61/103,328, filed on Oct. 7, 2008, provisional application No. 61/021,810, filed on Jan. 17, 2008.

(51) Int. Cl.
*H01R 12/00* (2006.01)

(52) U.S. Cl. ..... 439/66

(58) Field of Classification Search ..... 439/66, 439/74, 76.1, 79, 82, 75, 324, 248
See application file for complete search history.

(56) References Cited

U.S. PATENT DOCUMENTS

| | | | | |
|---|---|---|---|---|
| 4,538,866 | A | 9/1985 | Johnson | |
| 4,540,229 | A | 9/1985 | Madden | |
| 4,887,974 | A | 12/1989 | Ichimura et al. | |
| 4,927,369 | A | 5/1990 | Grabbe et al. | |
| 5,174,763 | A | 12/1992 | Wilson | |
| 5,217,383 | A * | 6/1993 | Hildebrandt et al. | 439/259 |
| 5,237,743 | A | 8/1993 | Busacco et al. | |
| 5,248,262 | A | 9/1993 | Busacco et al. | |
| 5,380,210 | A | 1/1995 | Grabbe et al. | |
| 5,415,559 | A | 5/1995 | Ichimura | |
| 5,470,245 | A | 11/1995 | Ichimura | |
| 5,704,795 | A | 1/1998 | Lindeman | |
| 5,953,214 | A | 9/1999 | Dranchak et al. | |

(Continued)

FOREIGN PATENT DOCUMENTS

| | | |
|---|---|---|
| JP | 6-36832 | 2/1994 |

(Continued)

OTHER PUBLICATIONS

See present application—prior art Figures 12-C, 12-D and description at pp. 9 to 12 disclosing prior art interposer assemblies.

*Primary Examiner*—Neil Abrams
*Assistant Examiner*—Phuong Nguyen
(74) *Attorney, Agent, or Firm*—Hooker & Habib, P.C.

(57) ABSTRACT

An interposer assembly for forming electrical connections between contact pads on opposed substrates includes a top plate, a bottom plate, a lateral shift interface between the plates and a plurality of electrical circuit paths extending between contact surfaces at the top of the top plate and at the bottom of the bottom plate. The circuit paths maintain electrical connections between opposed pairs of pads on the substrates despite misalignment of the substrates or lateral shifting of the plates at the interface because of forces exerted on the substrates. The plates are secured together to permit limited lateral movement at the interface. The assembly may have a circuit board plate between the top and bottom plates and two lateral shift interfaces. The contacts may have very small and high contact pressure shear-formed contact tips.

52 Claims, 32 Drawing Sheets

U.S. PATENT DOCUMENTS

| | | | | |
|---|---|---|---|---|
| 6,113,440 | A | 9/2000 | Fijten et al. | |
| 6,241,531 | B1 | 6/2001 | Roath et al. | |
| 6,281,692 | B1 | 8/2001 | Bodenweber et al. | |
| 6,390,826 | B1 | 5/2002 | Affolter et al. | |
| 6,488,522 | B2 | 12/2002 | Fukunaga | |
| 6,545,226 | B2 | 4/2003 | Brodsky et al. | |
| 6,730,134 | B2 | 5/2004 | Neidich | |
| 6,746,252 | B1 | 6/2004 | Scott | |
| 6,756,797 | B2 | 6/2004 | Brandorff et al. | |
| 6,892,451 | B2 | 5/2005 | Brodsky et al. | |
| 6,905,343 | B1 | 6/2005 | Neidich | |
| 6,974,915 | B2 | 12/2005 | Brodsky et al. | |
| 7,029,289 | B2 | 4/2006 | Li | |
| 7,126,062 | B1 | 10/2006 | Vinther et al. | |
| 7,241,149 | B2 * | 7/2007 | Abadia | 439/75 |
| 7,293,995 | B2 * | 11/2007 | Li | 439/66 |
| 7,404,717 | B2 | 7/2008 | Kazama | |
| 7,446,544 | B2 | 11/2008 | Igarashi et al. | |
| 2006/0116004 | A1 * | 6/2006 | Rathburn | 439/66 |

FOREIGN PATENT DOCUMENTS

| | | |
|---|---|---|
| JP | 6-132044 | 5/1994 |
| JP | 9-312182 | 12/1997 |
| JP | 10-50419 | 2/1998 |
| JP | 10-55854 | 2/1998 |

* cited by examiner

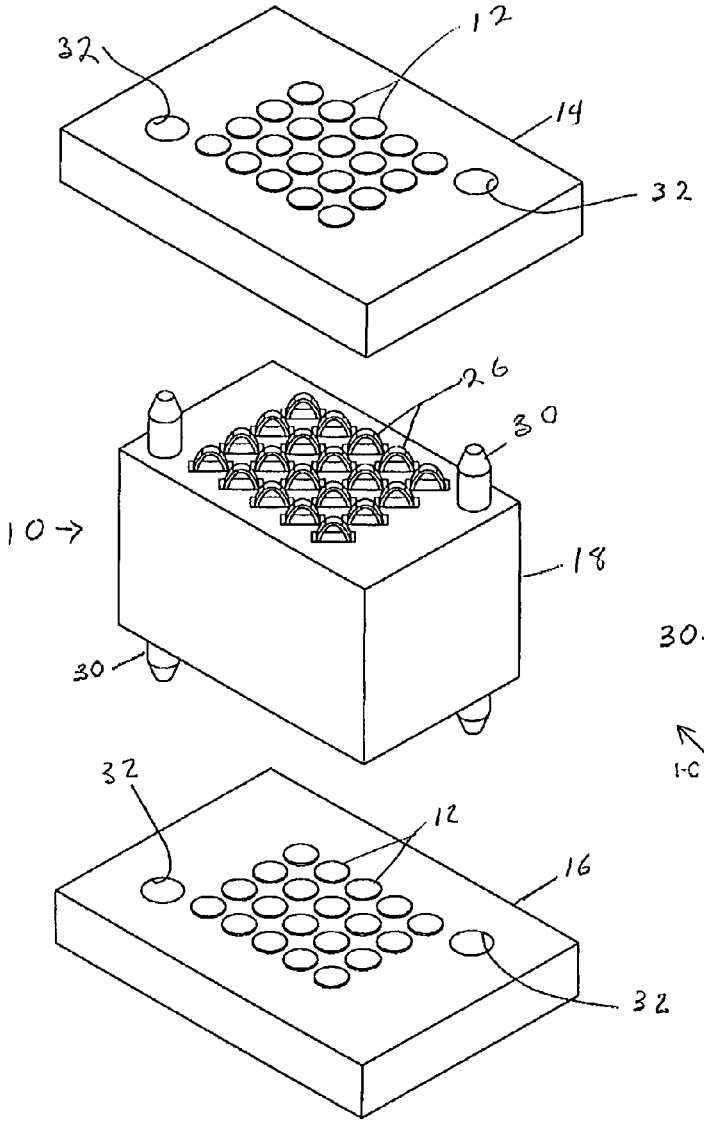
FIGURE 1-A
PRIOR ART
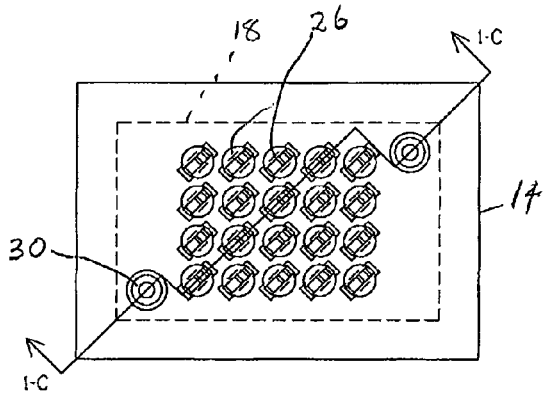
FIGURE 1-B
PRIOR ART

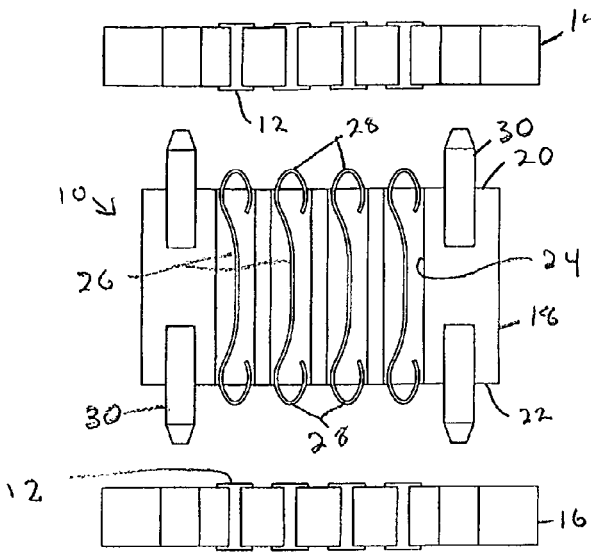
FIGURE 1-C
PRIOR ART
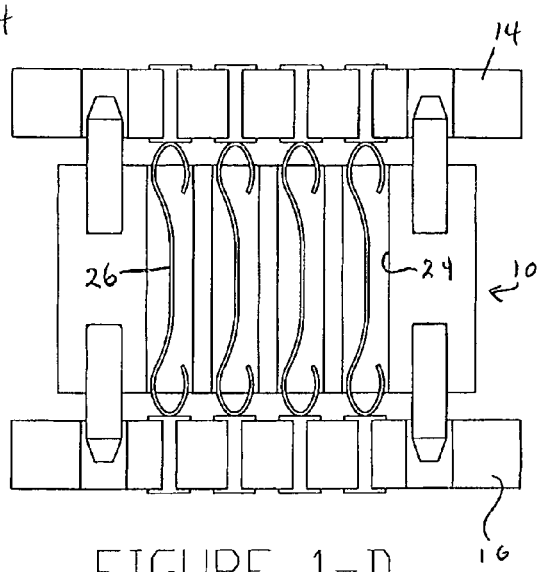
FIGURE 1-D
PRIOR ART
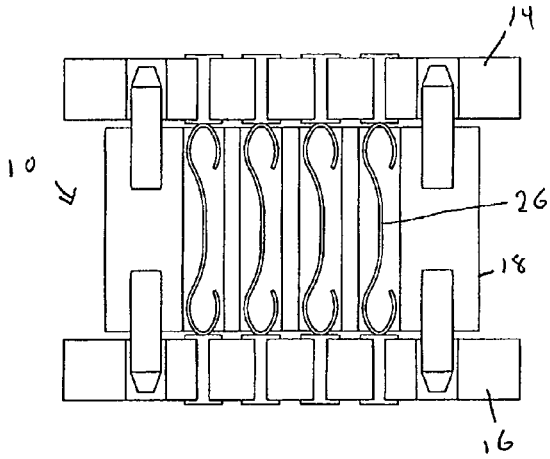
FIGURE 1-E
PRIOR ART
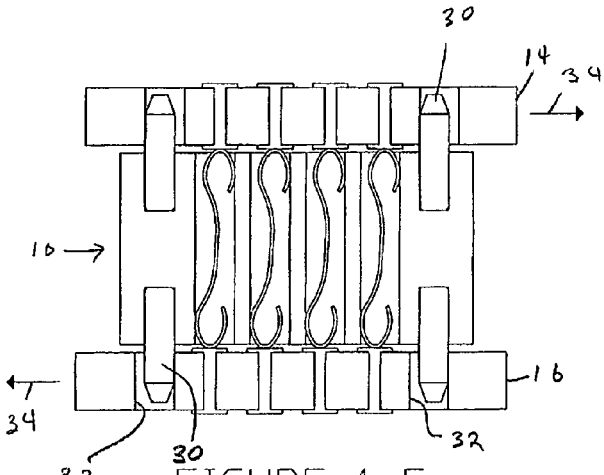
FIGURE 1-F
PRIOR ART

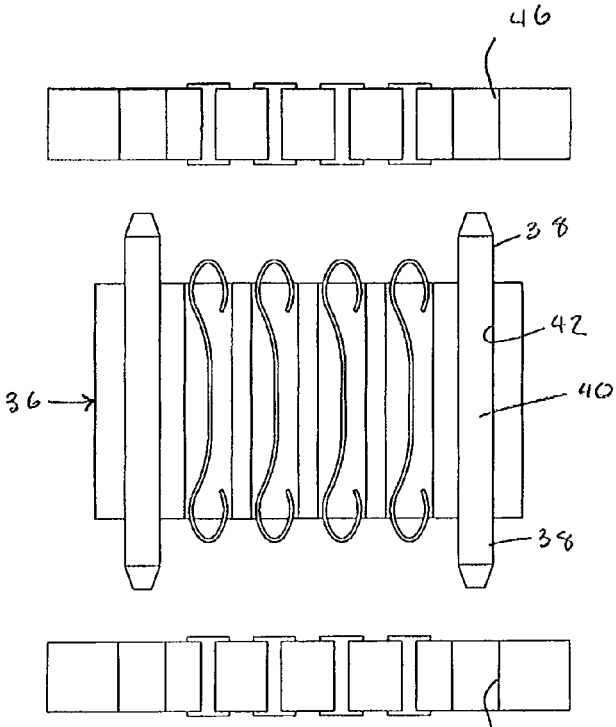
FIGURE 1-G
PRIOR ART
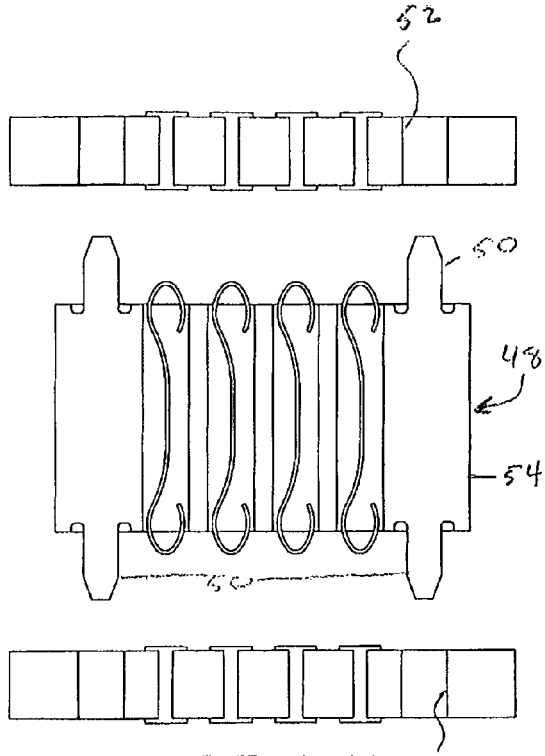
FIGURE 1-H
PRIOR ART

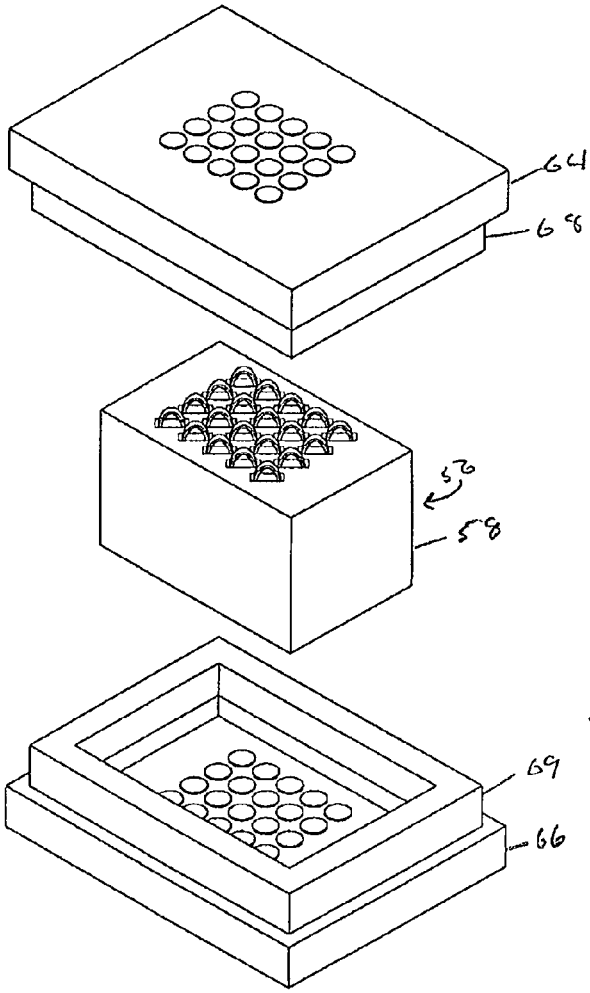
FIGURE 2-A
PRIOR ART
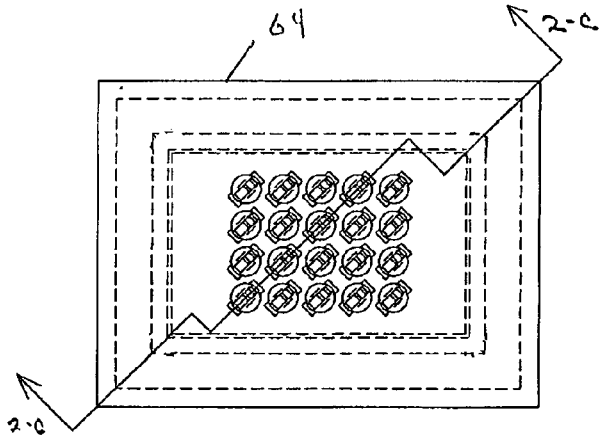
FIGURE 2-B
PRIOR ART

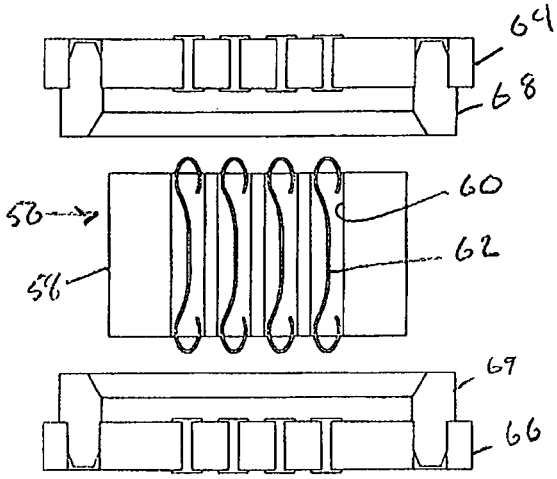
FIGURE 2-C
PRIOR ART
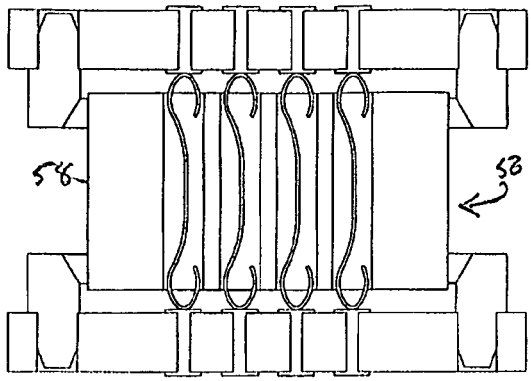
FIGURE 2-D
PRIOR ART
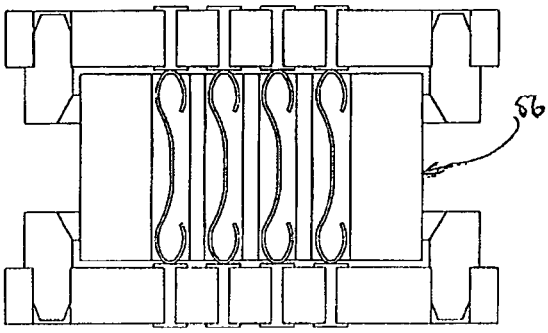
FIGURE 2-E
PRIOR ART
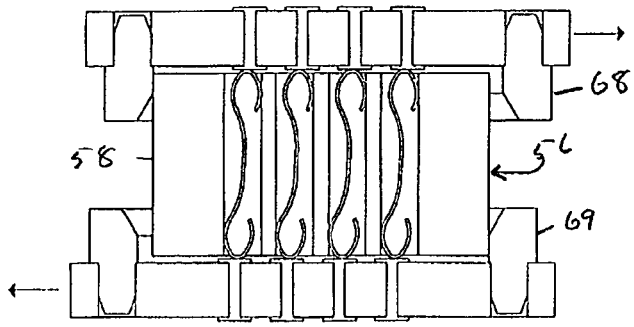
FIGURE 2-F
PRIOR ART

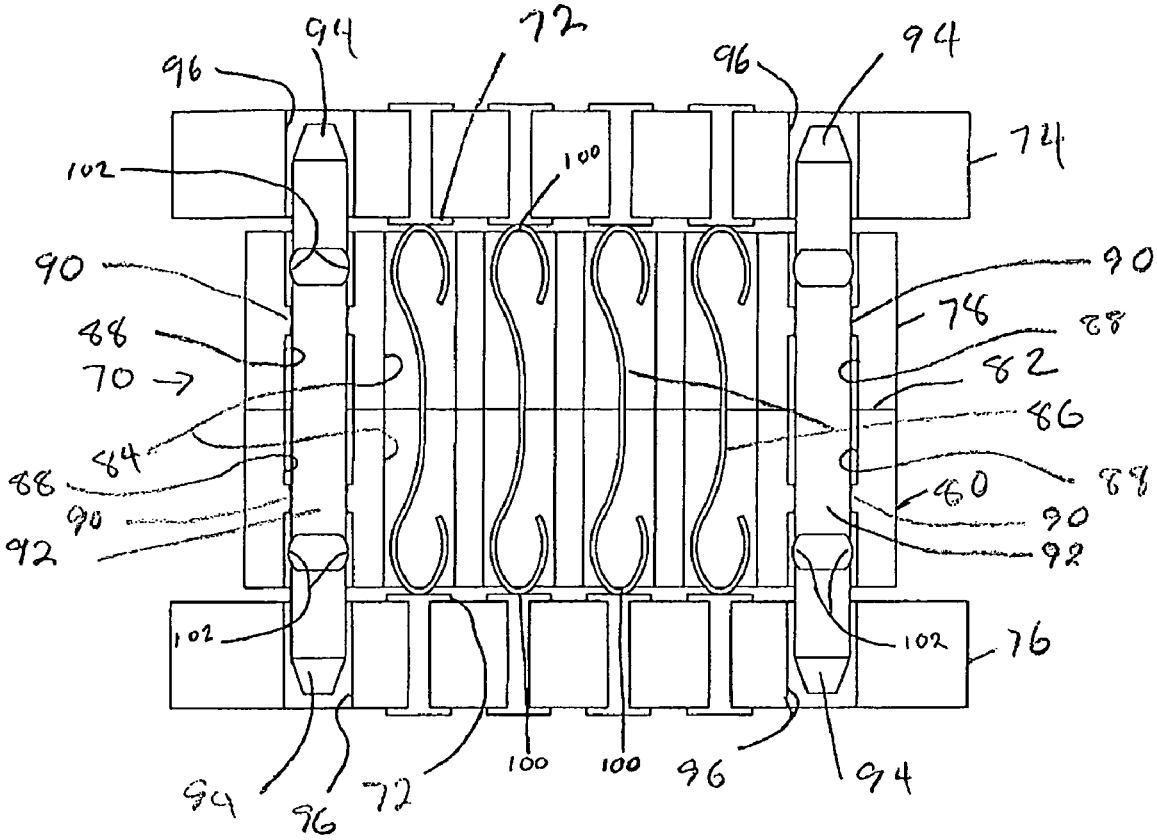
FIGURE 3-A
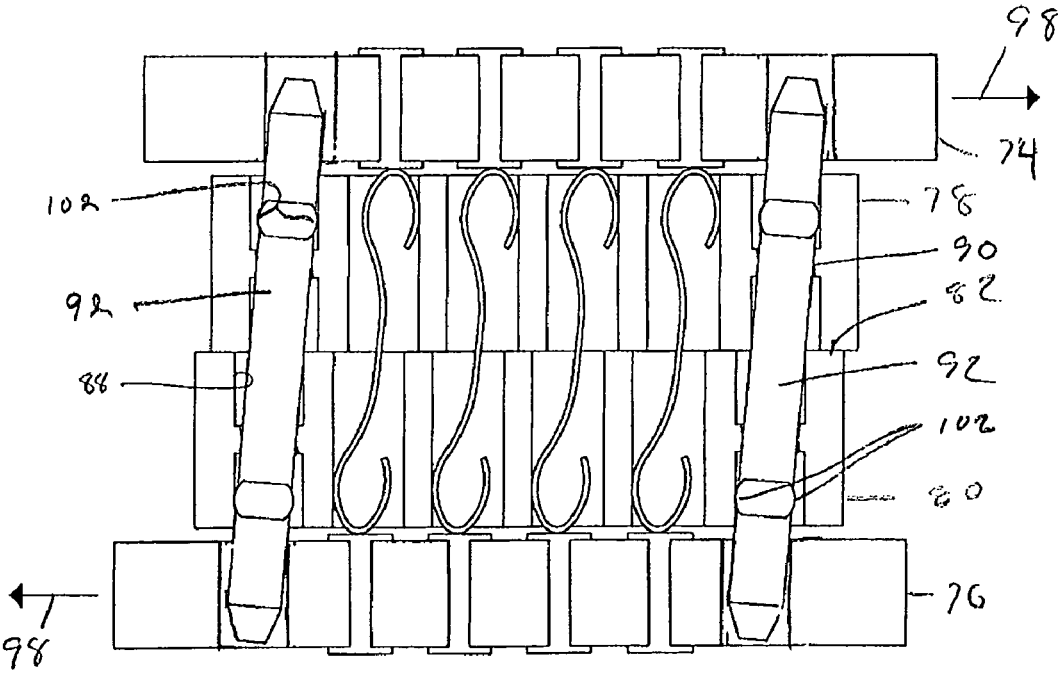
FIGURE 3-B

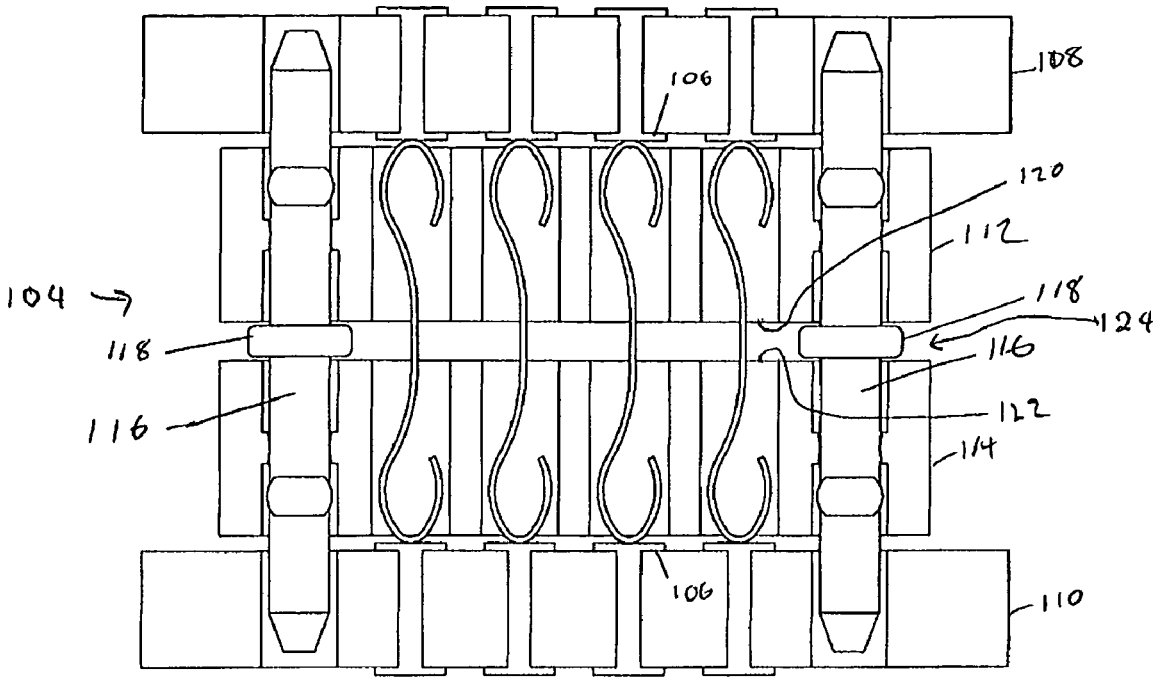
FIGURE 4-A
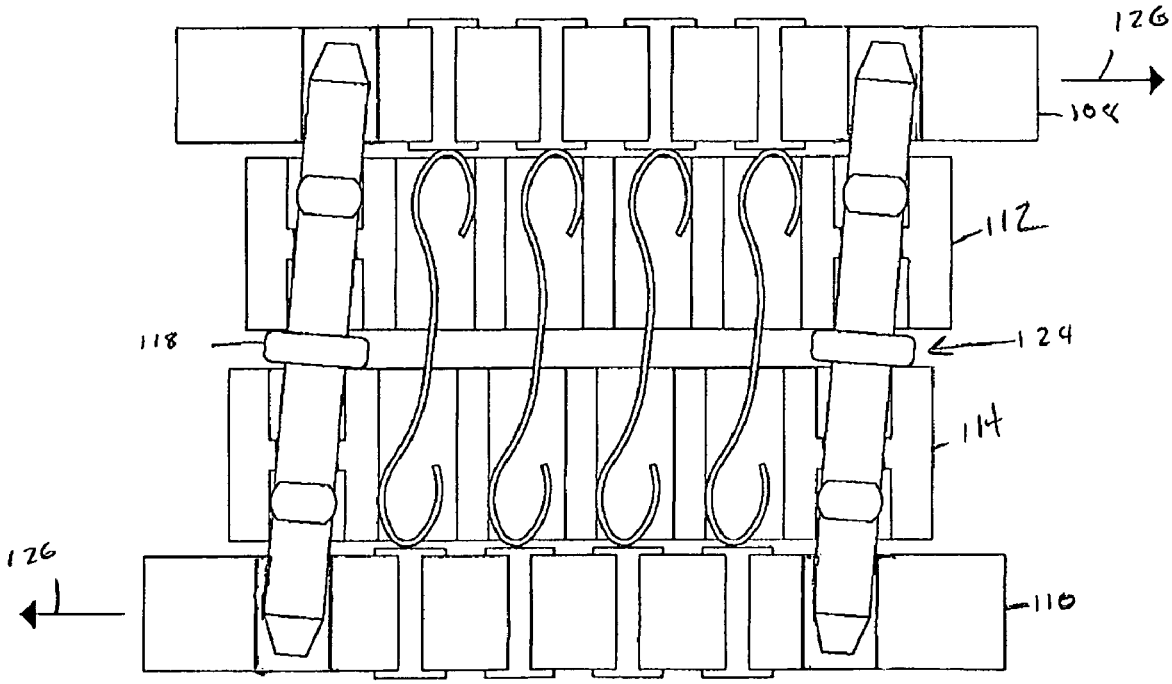
FIGURE 4-B

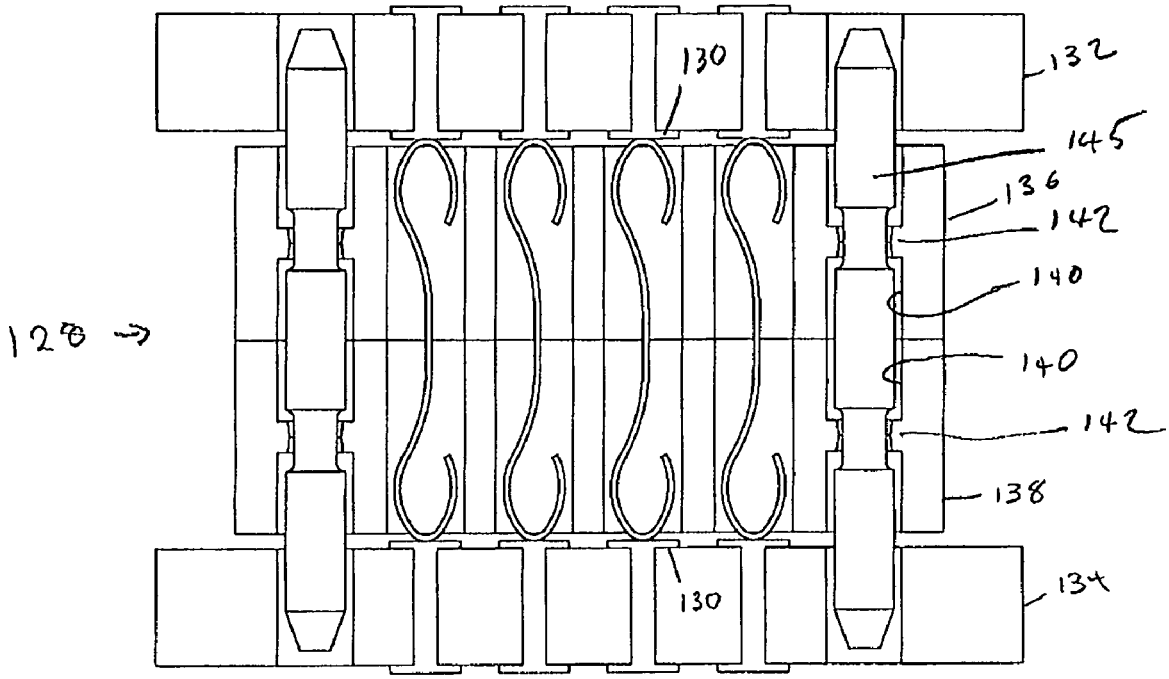
FIGURE 5-A
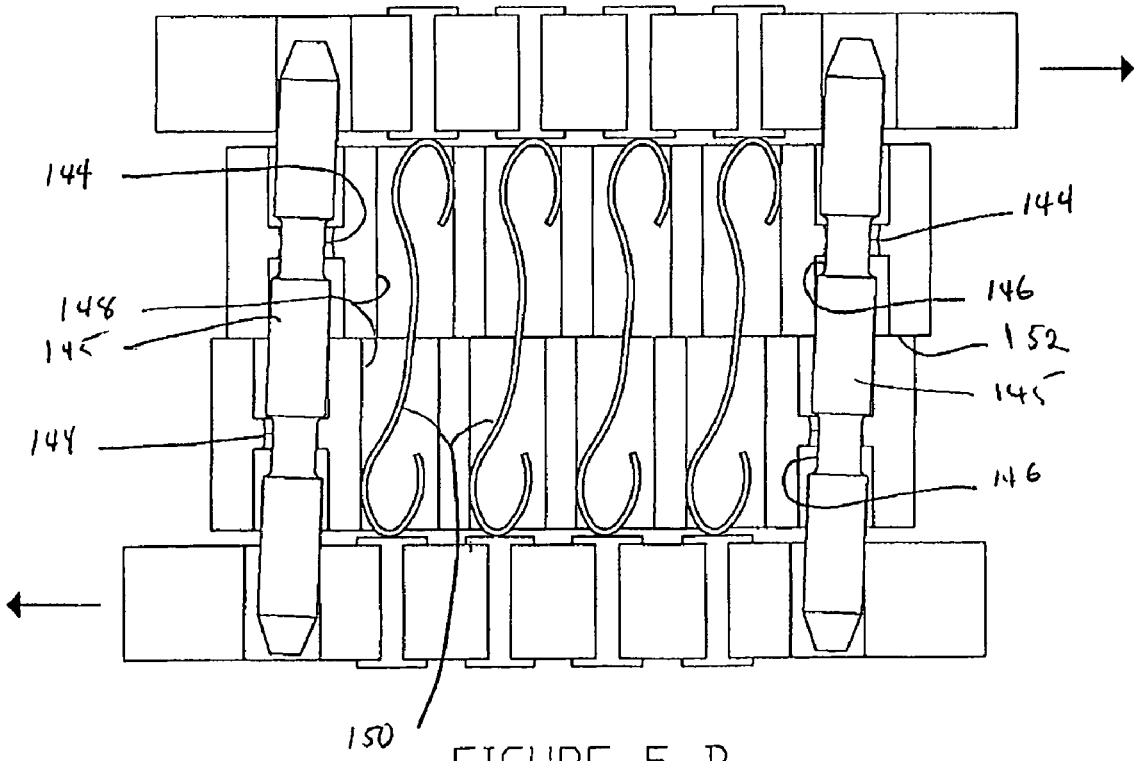
FIGURE 5-B

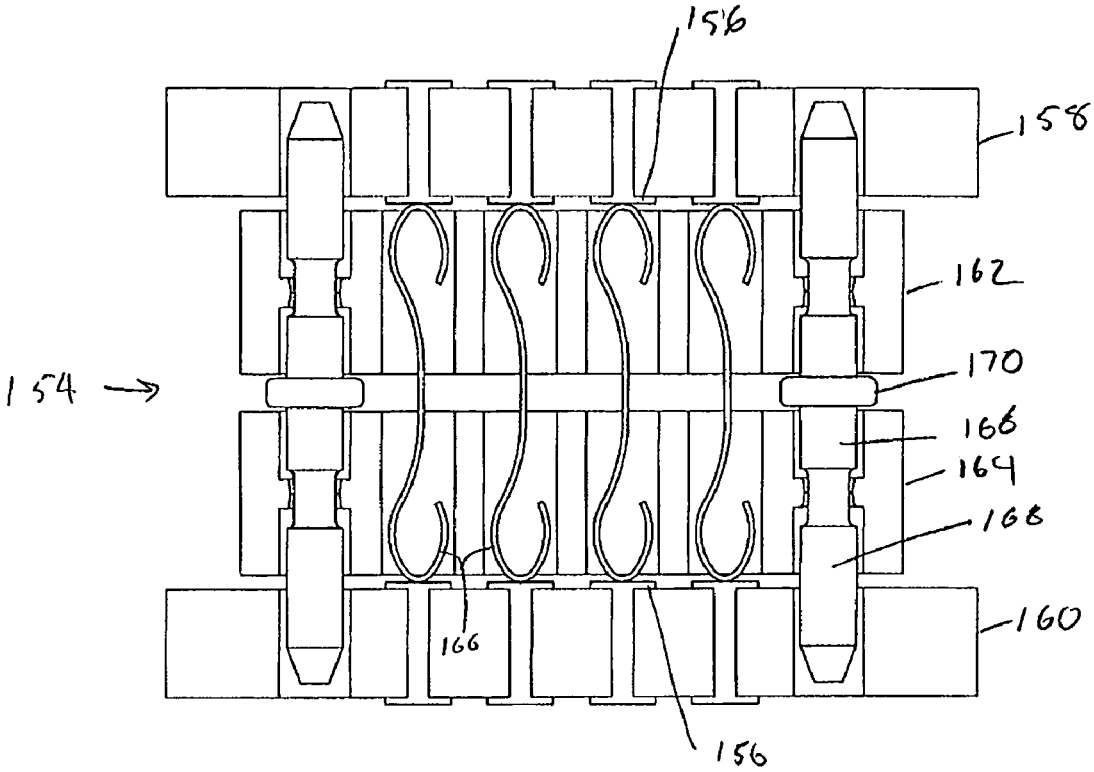
FIGURE 6-A
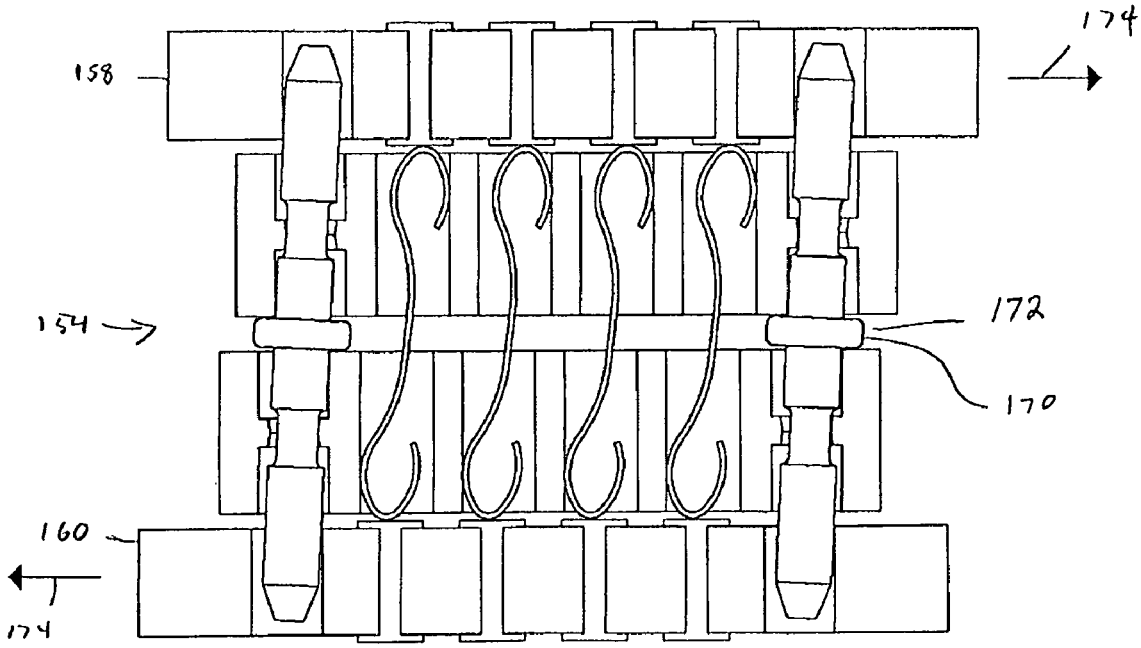
FIGURE 6-B

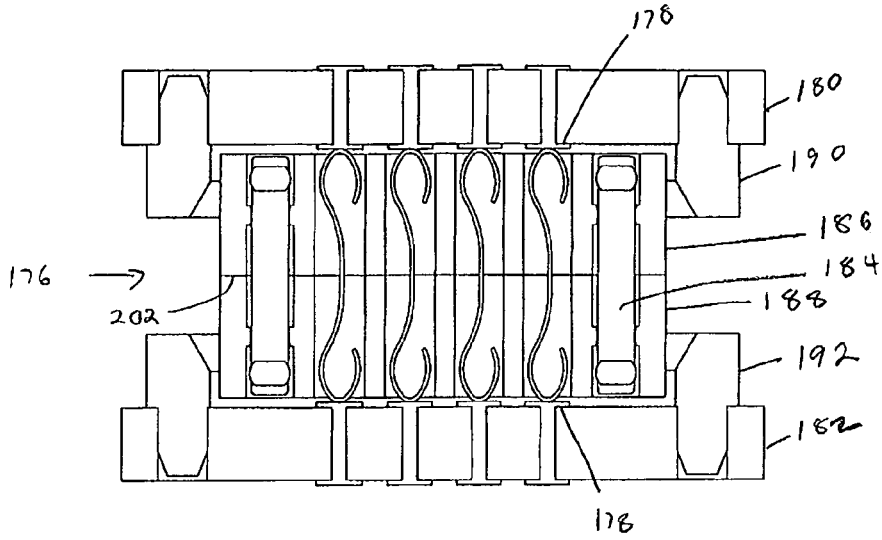
FIGURE 7-A
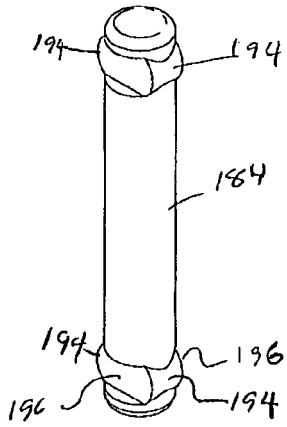
FIGURE 7-C
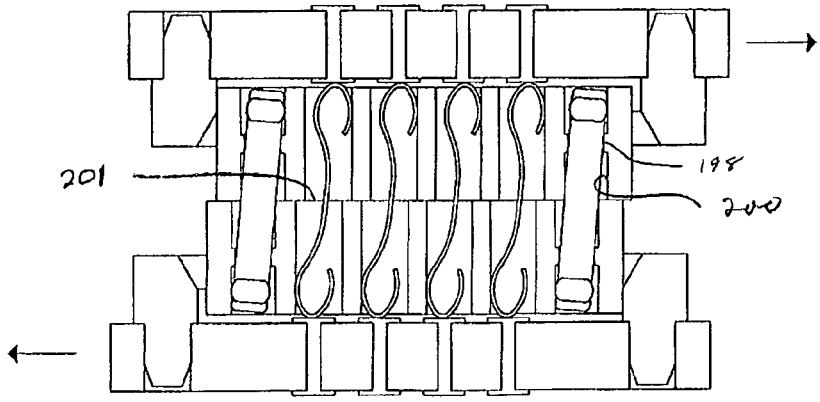
FIGURE 7-B

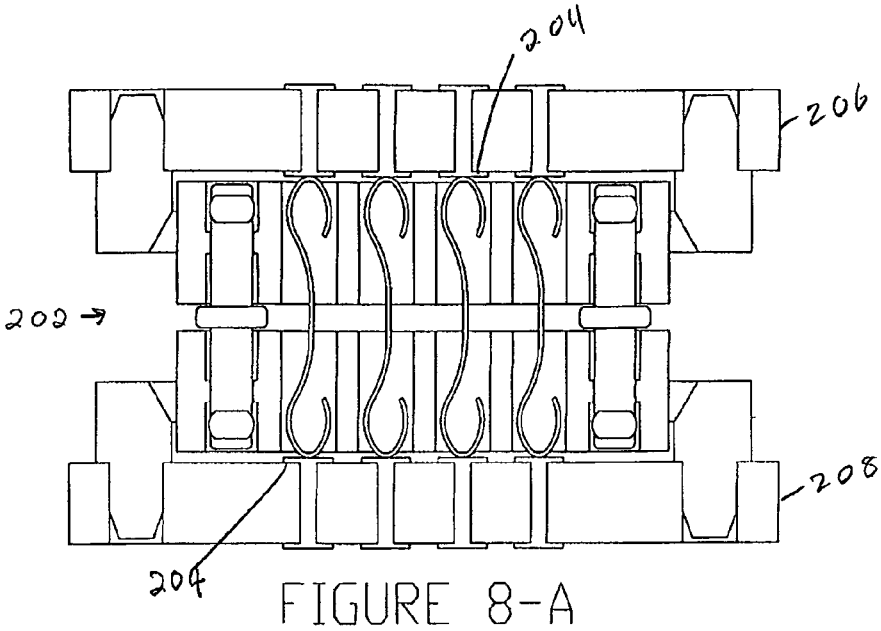
FIGURE 8-A
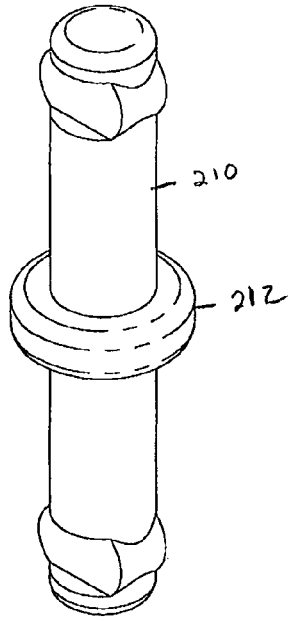
FIGURE 8-C
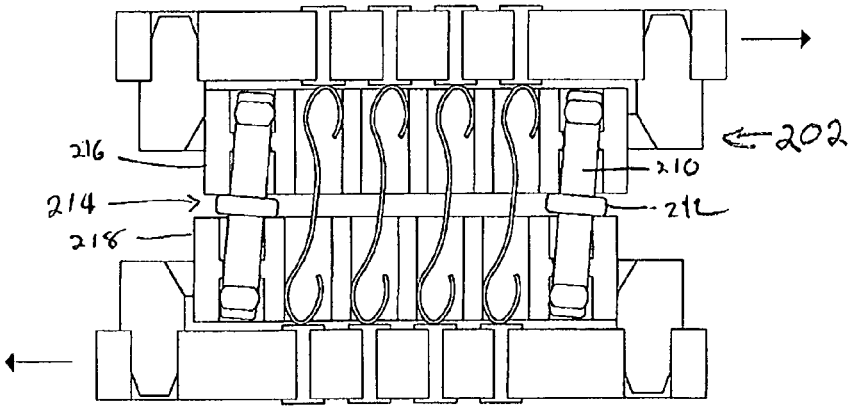
FIGURE 8-B

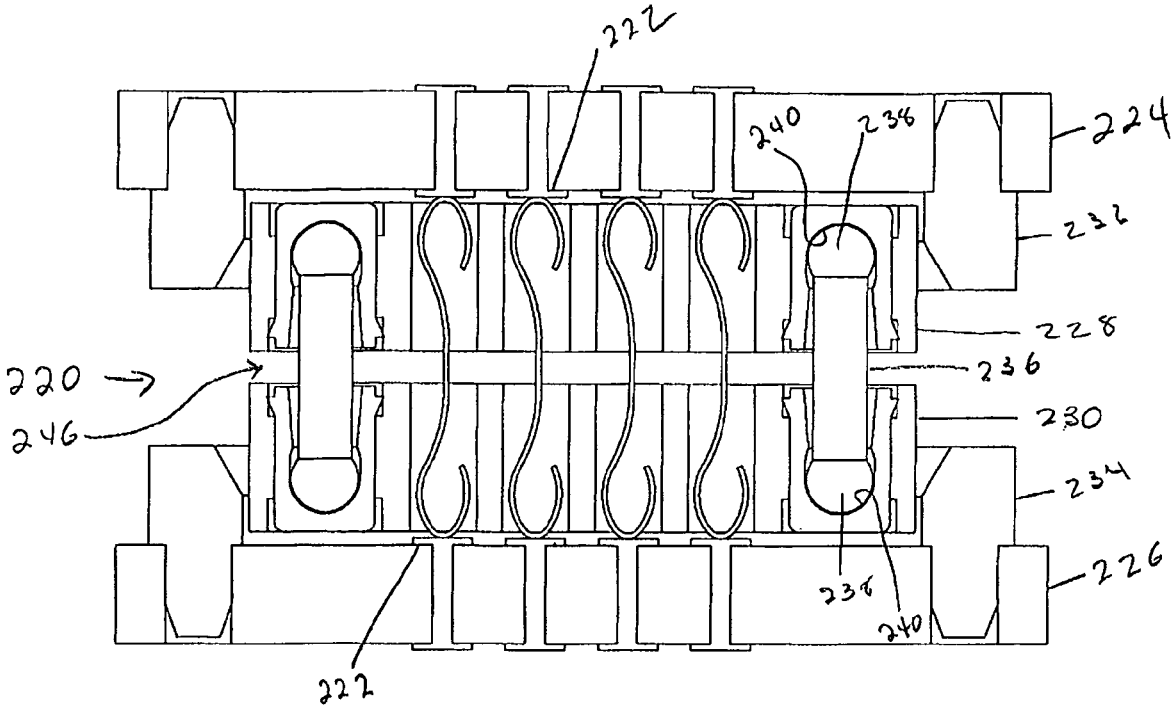
FIGURE 9-A
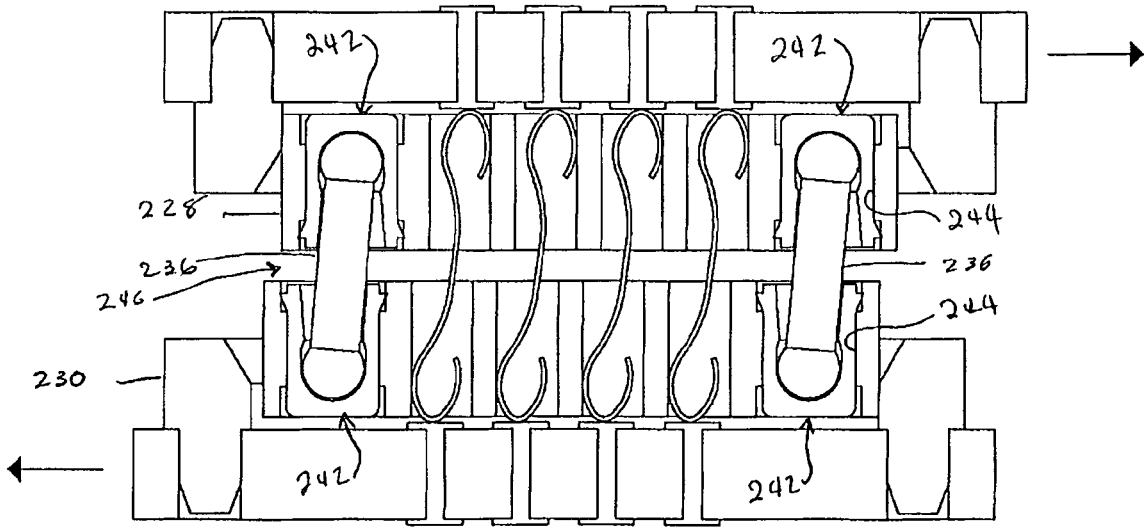
FIGURE 9-B

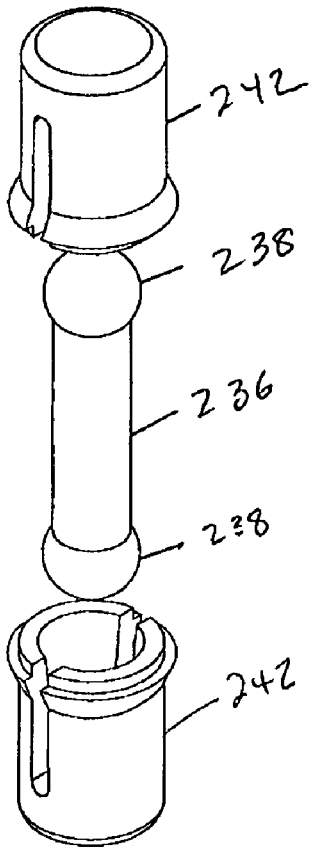
FIGURE 9-C
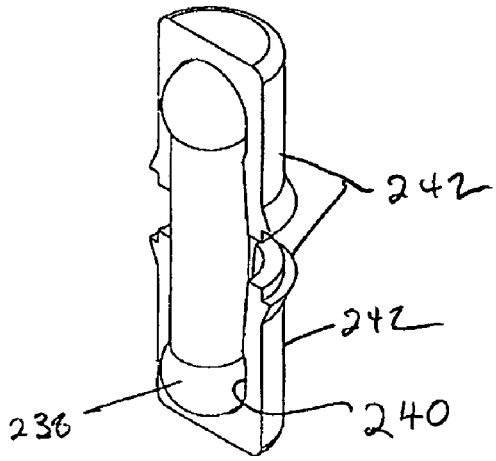
FIGURE 9-D
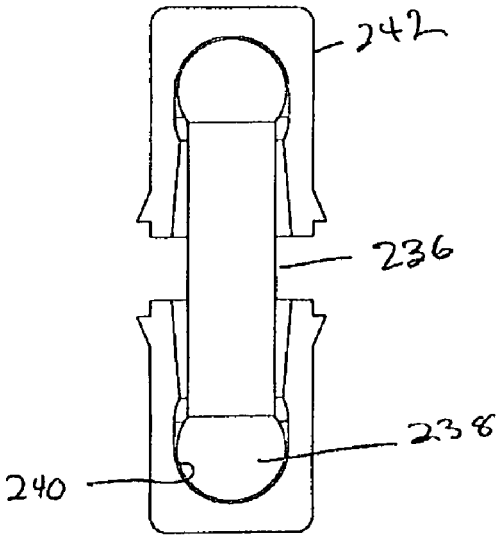
FIGURE 9-E
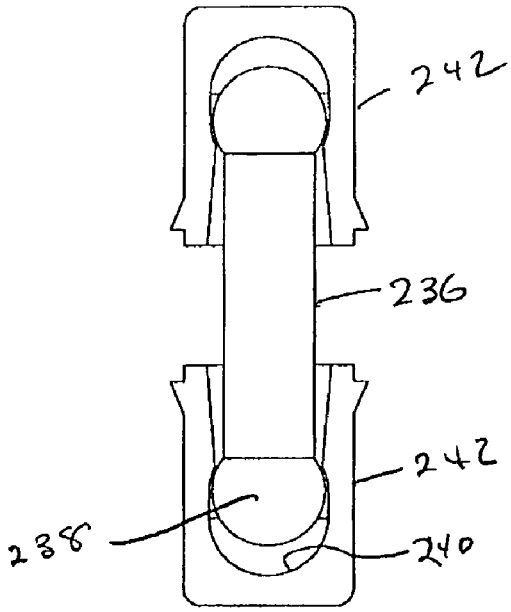
FIGURE 9-F

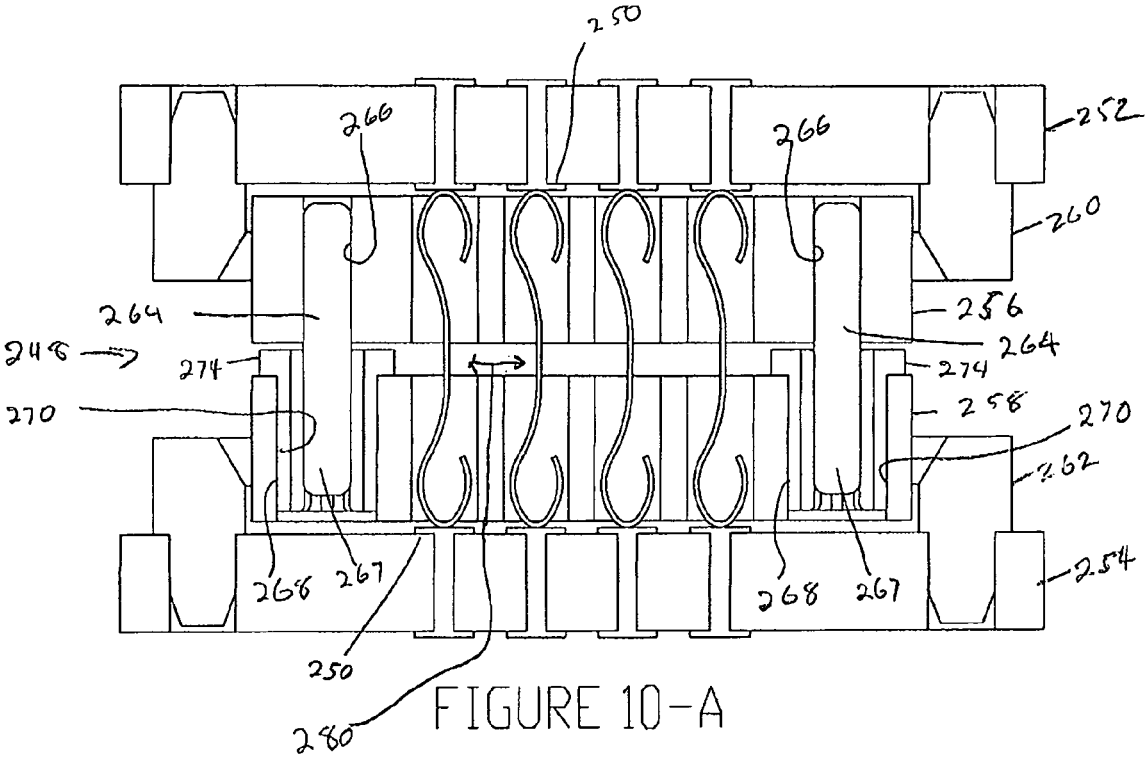
FIGURE 10-A
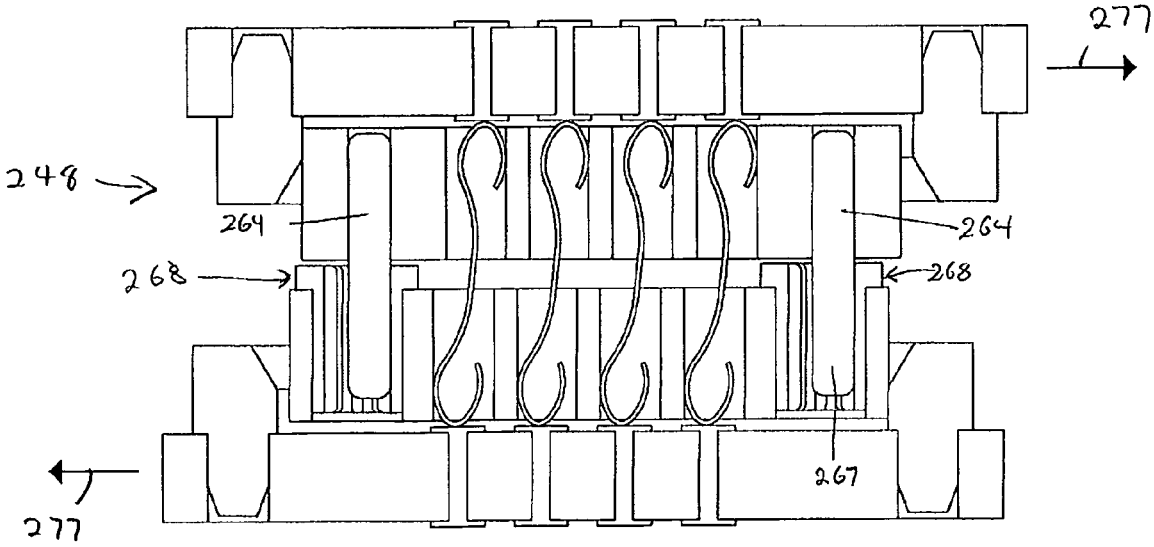
FIGURE 10-B

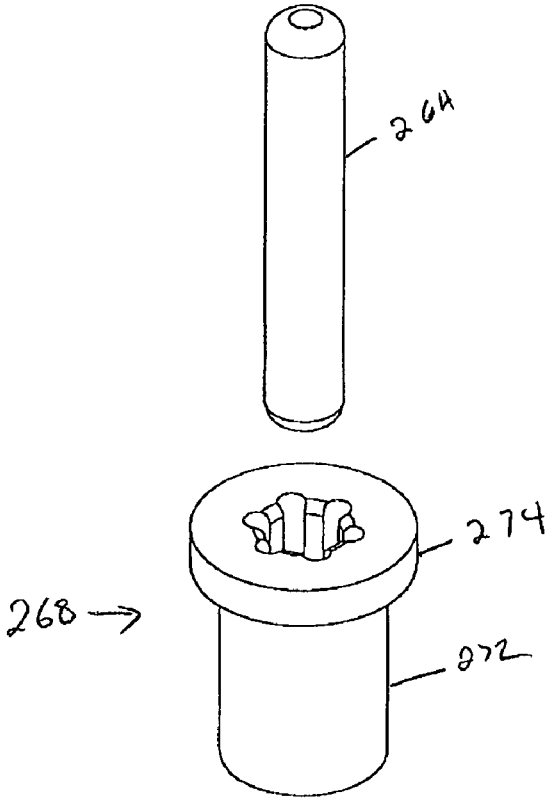
FIGURE 10-C
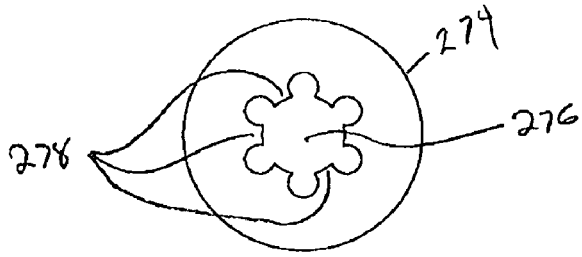
FIGURE 10-D
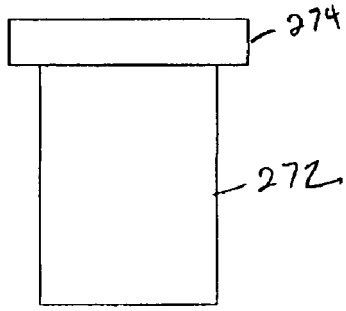
FIGURE 10-E

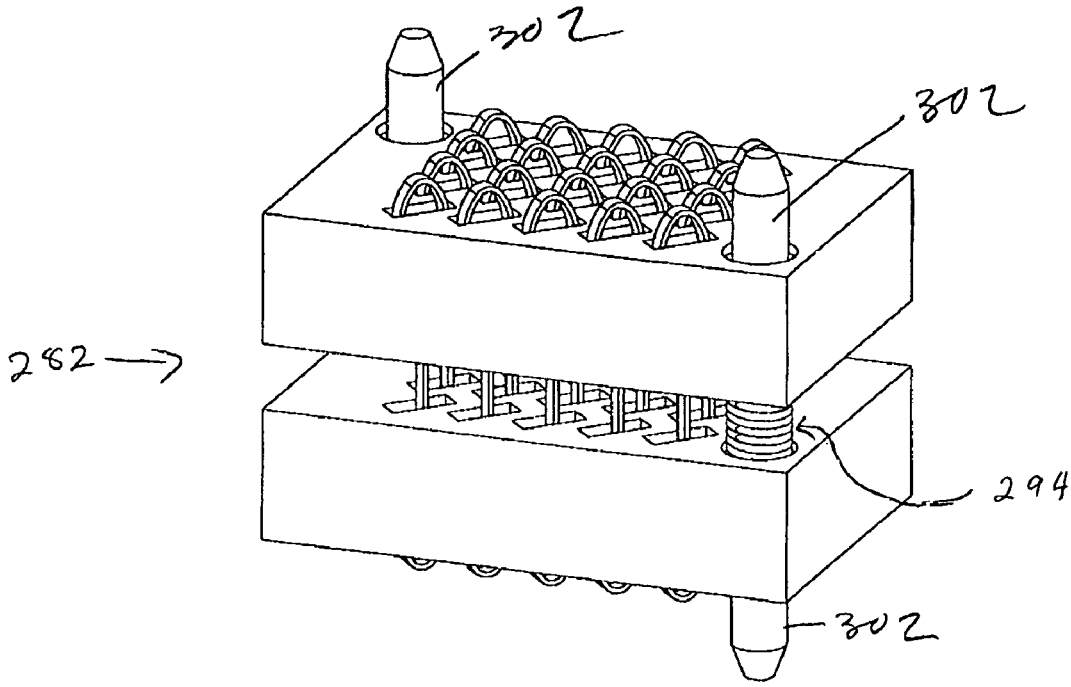
FIGURE 11-A
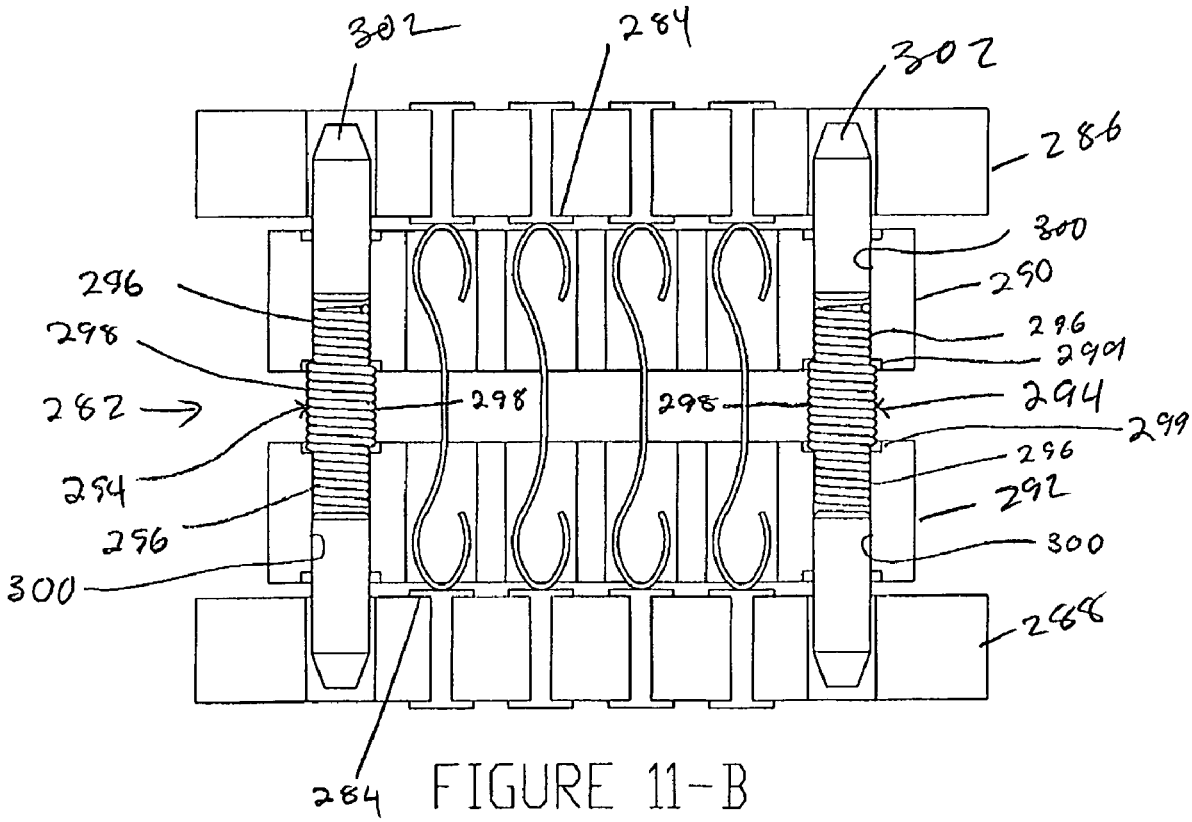
FIGURE 11-B

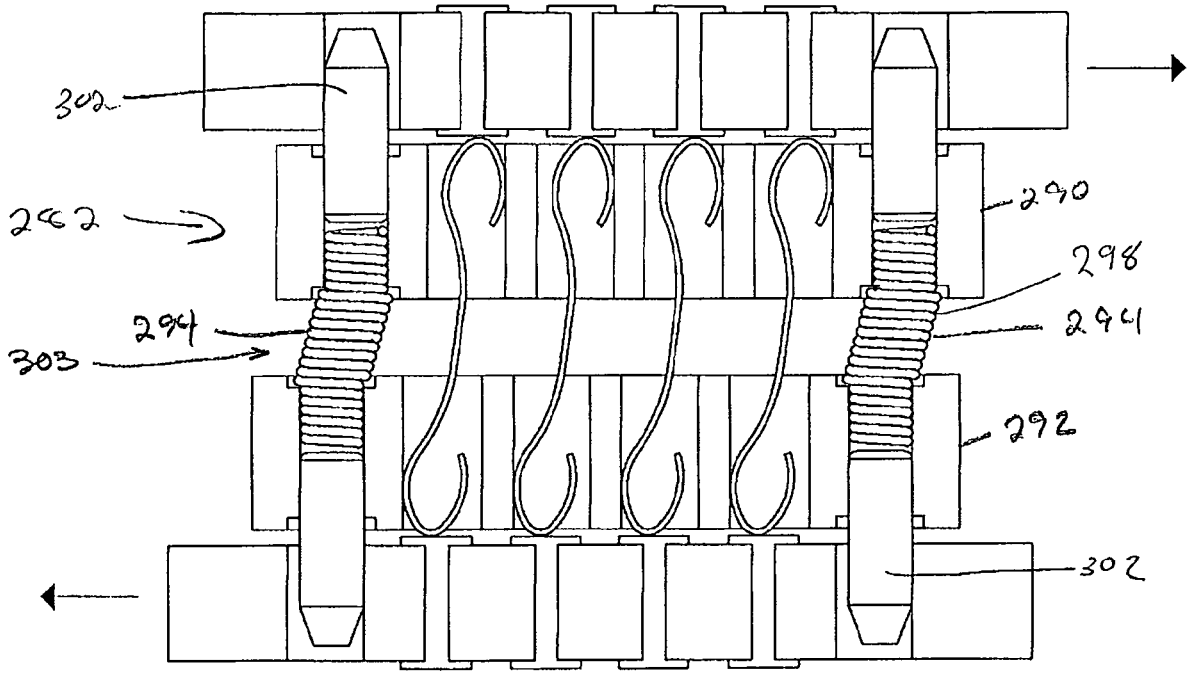
FIGURE 11-C

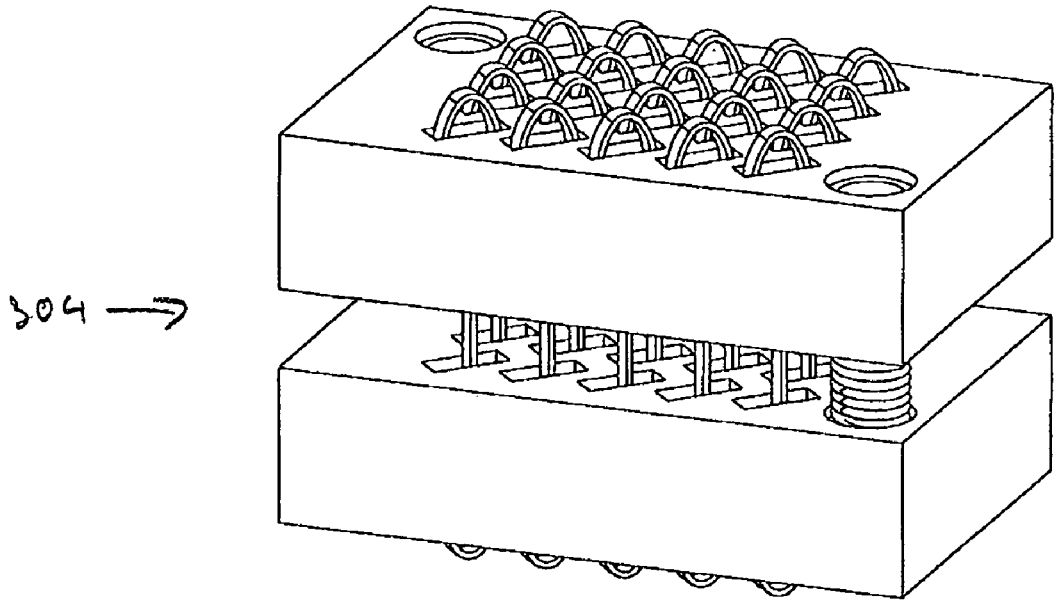
FIGURE 11-D
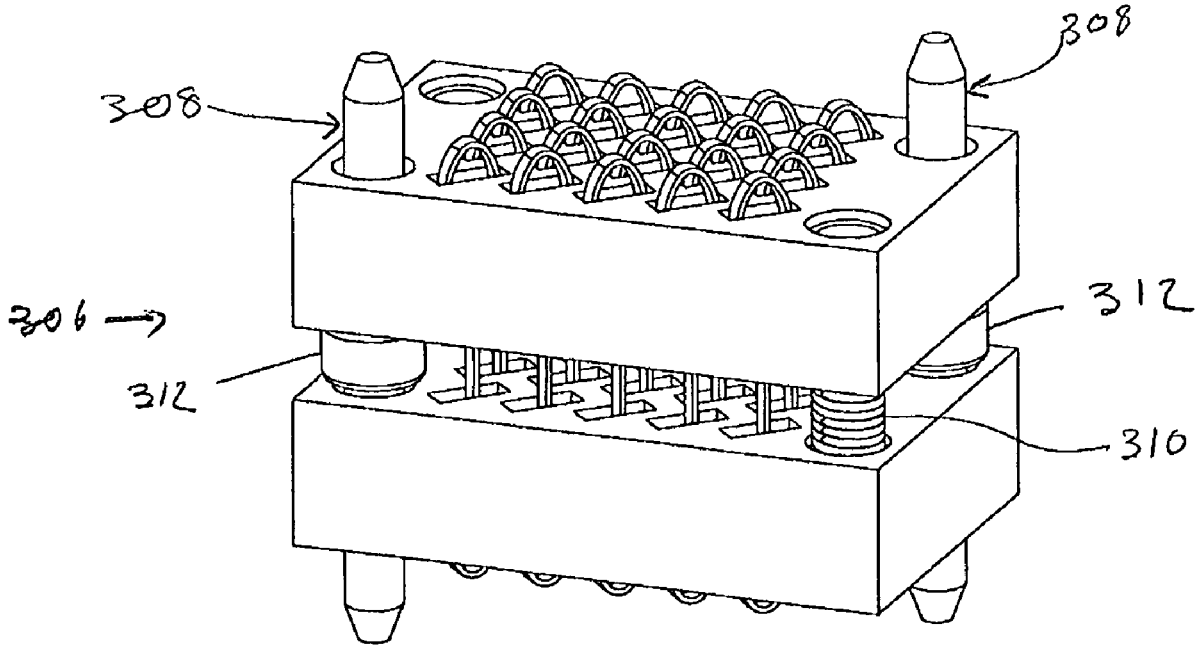
FIGURE 11-E

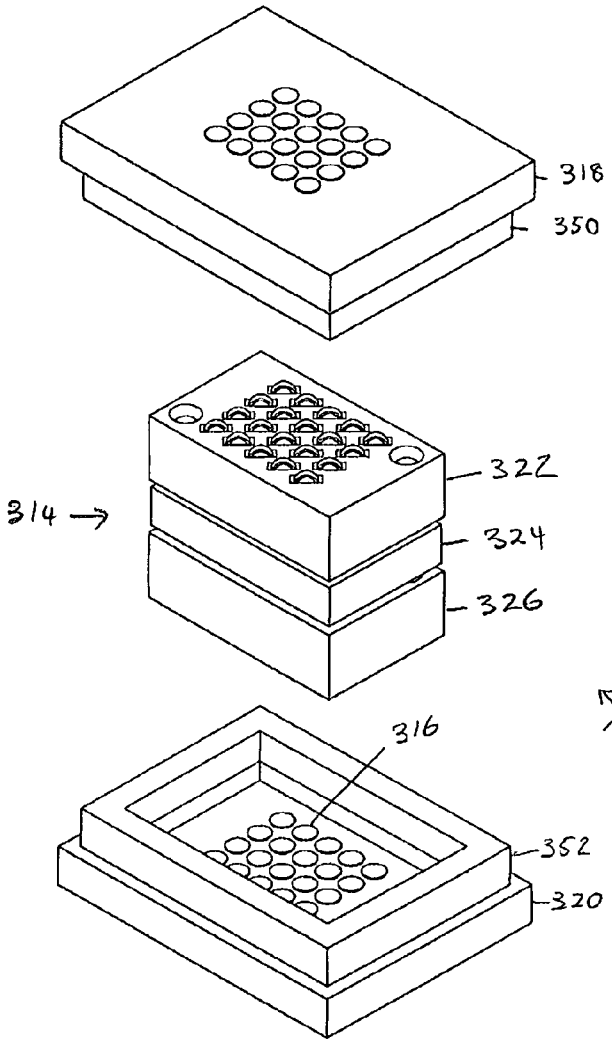
FIGURE 12-A
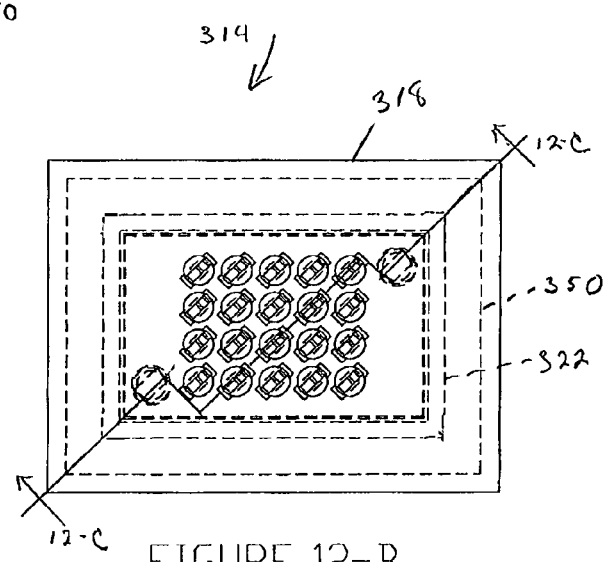
FIGURE 12-B

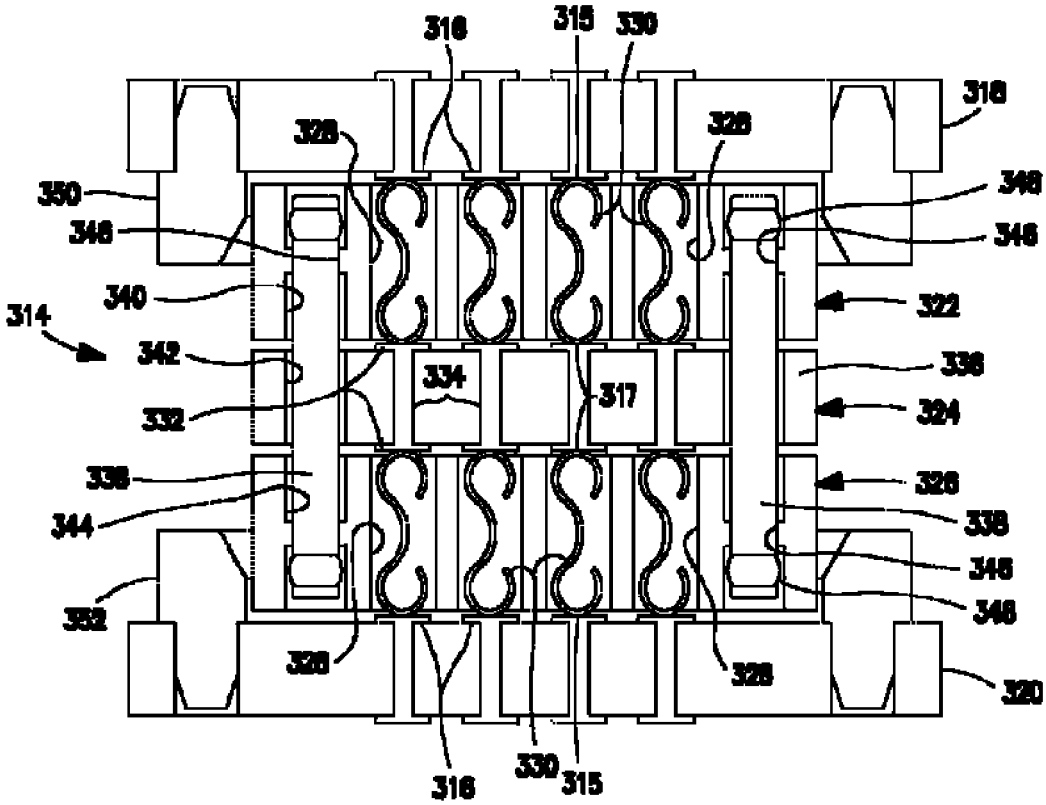
FIG. 12-C
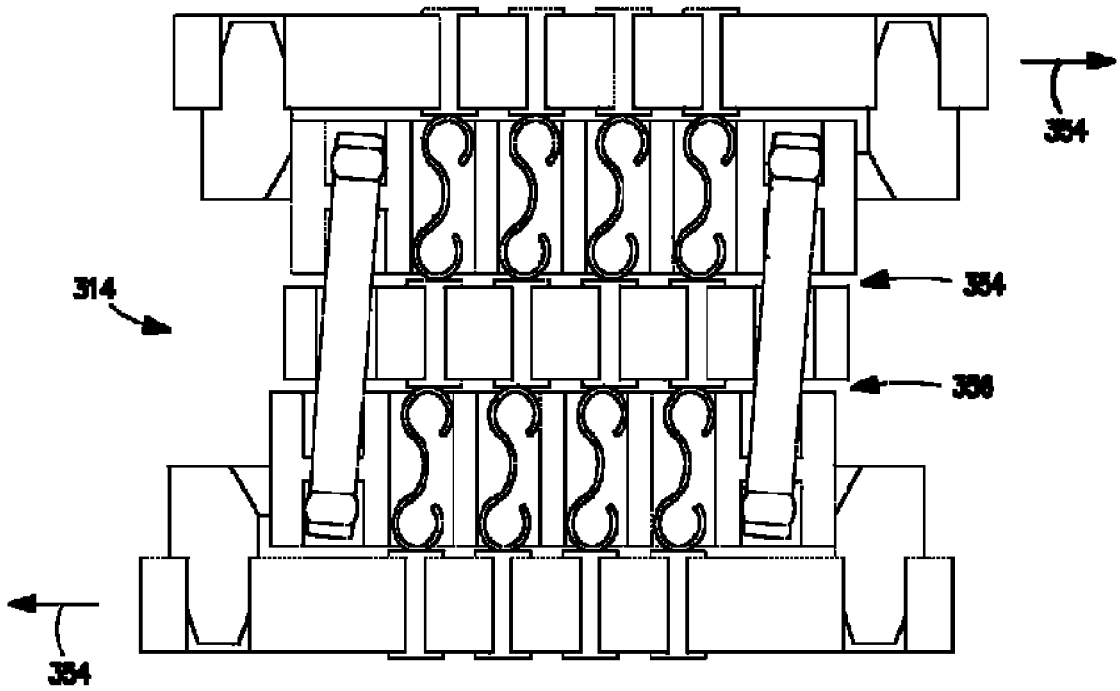
FIG. 12-D

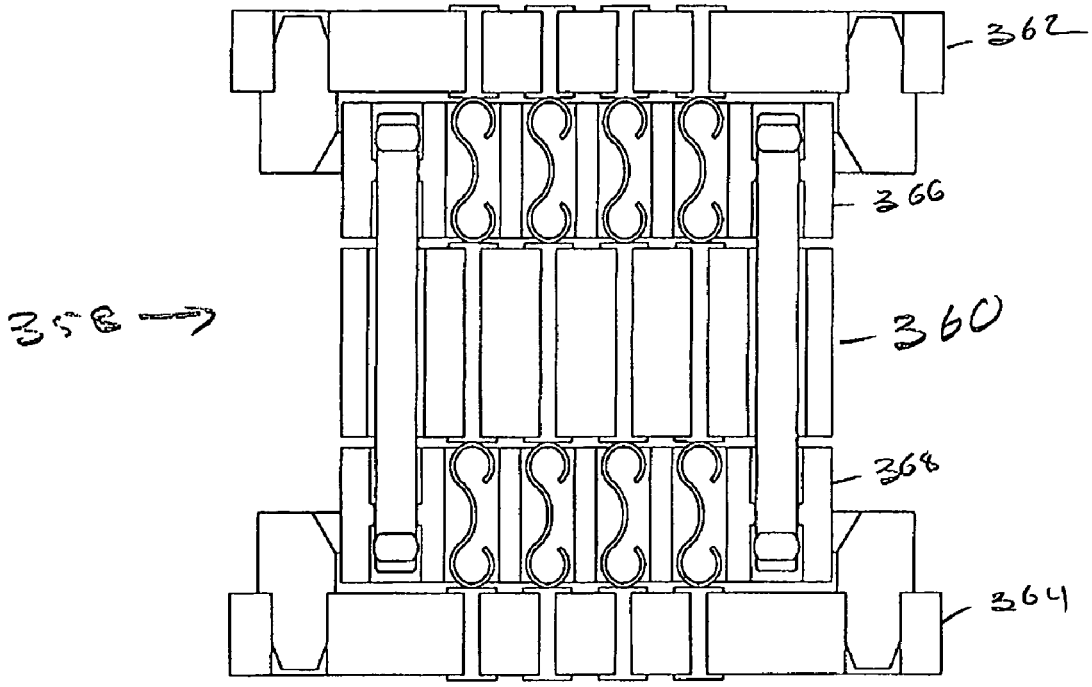
FIGURE 13-A
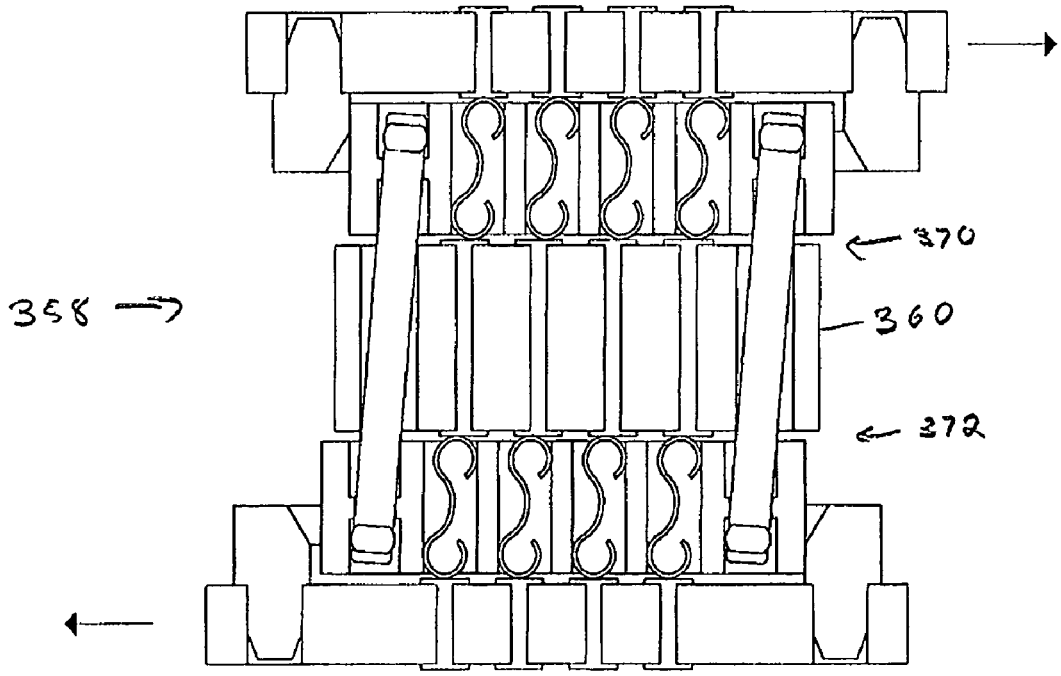
FIGURE 13-B

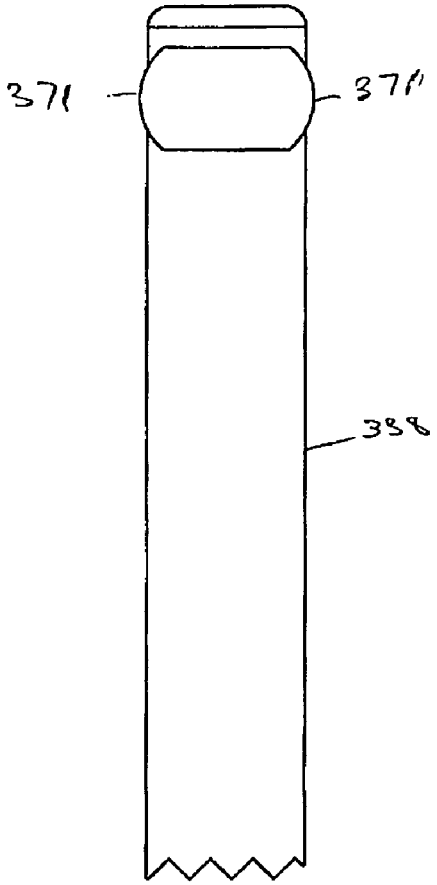
FIGURE 14-A
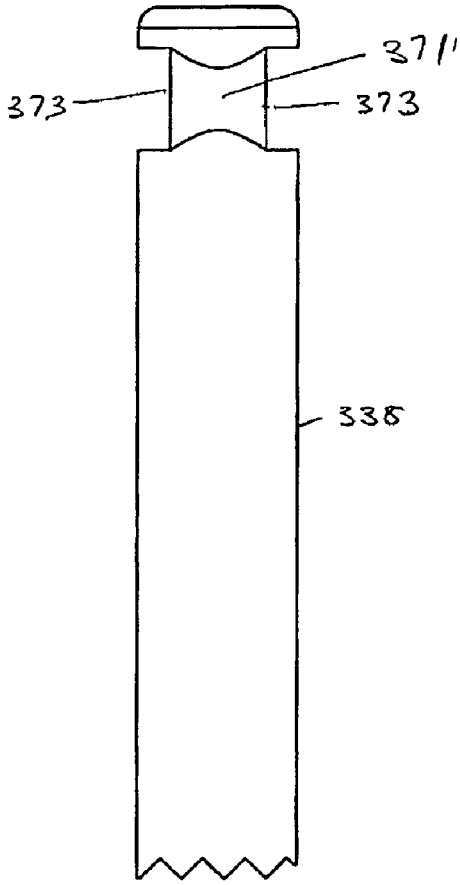
FIGURE 14-B

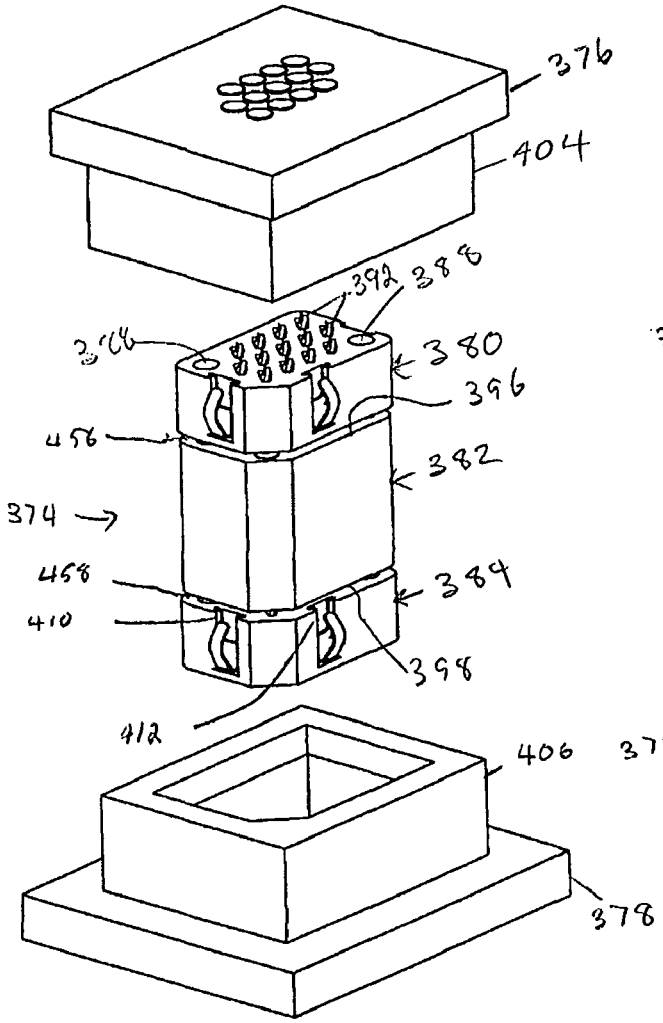
FIGURE 15-A
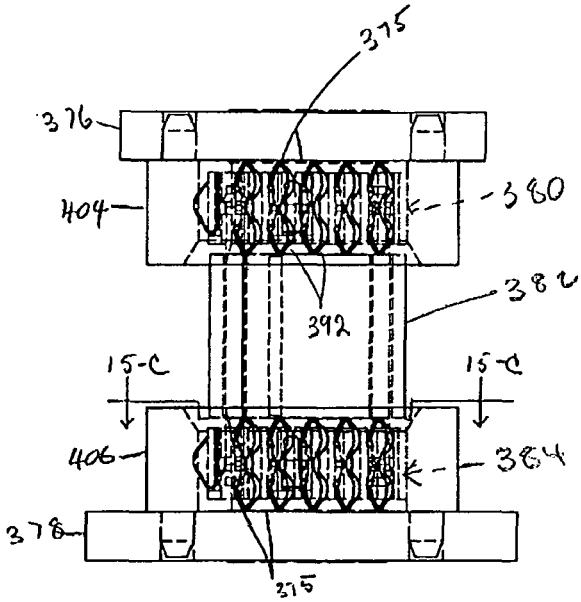
FIGURE 15-B

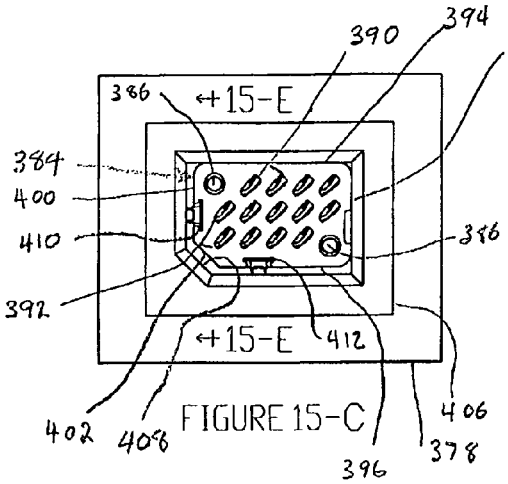
FIGURE 15-C
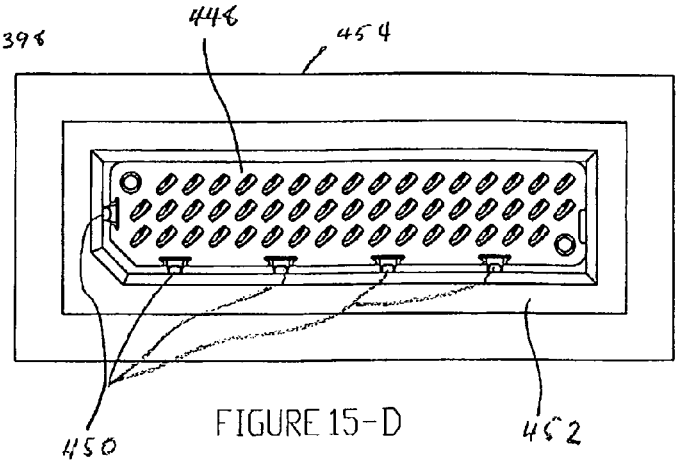
FIGURE 15-D
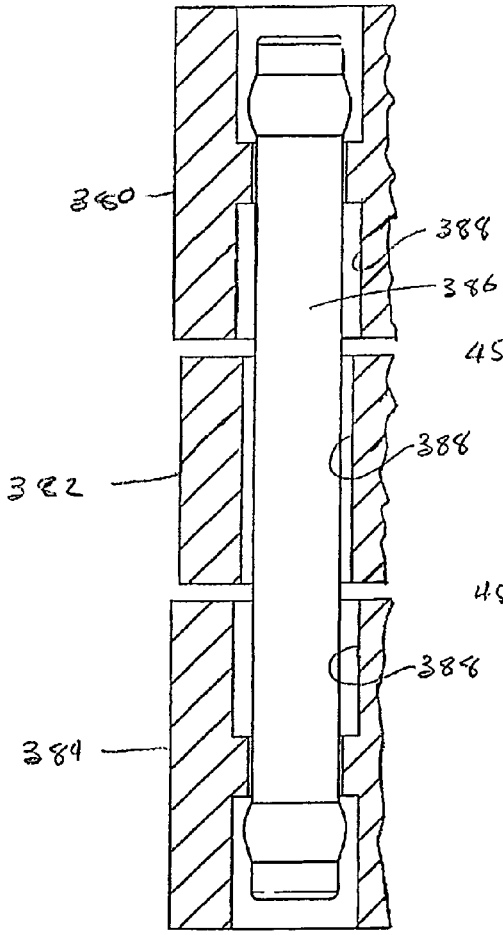
FIGURE 15-E
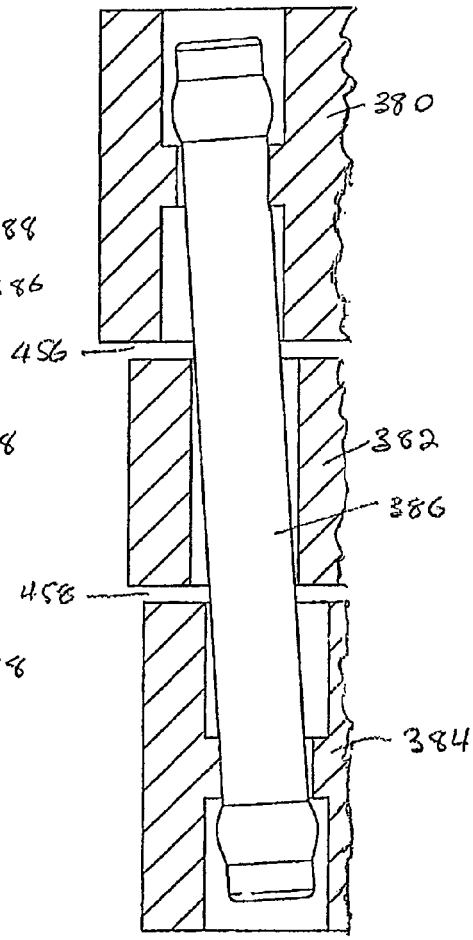
FIGURE 15-F

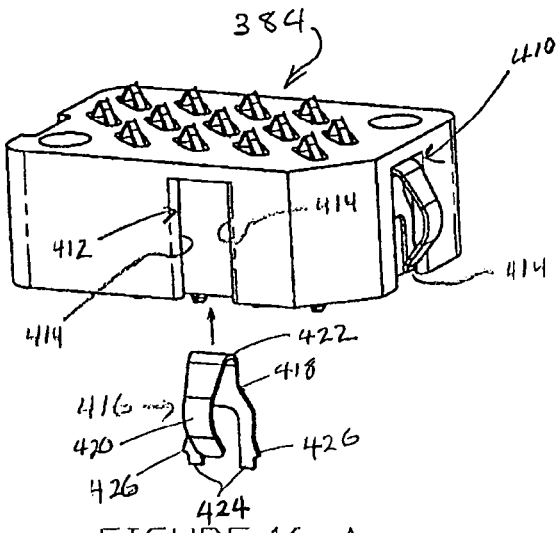
FIGURE 16-A
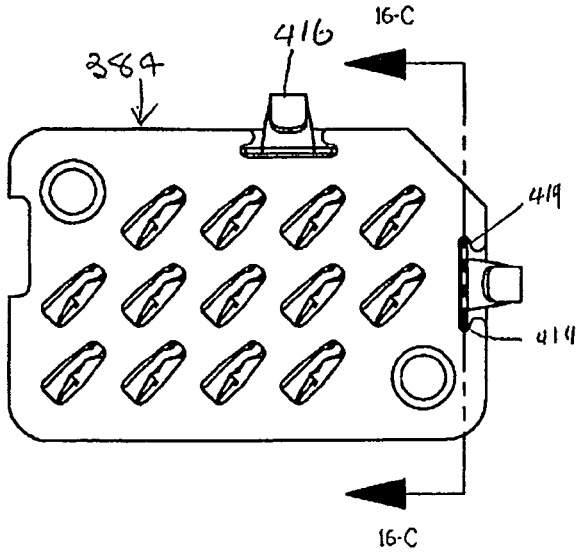
FIGURE 16-B
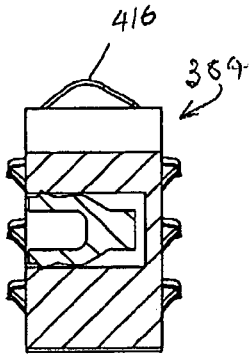
FIGURE 16-C
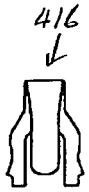
FIGURE 16-D
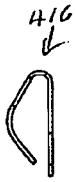
FIGURE 16-E
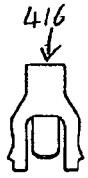
FIGURE 16-F

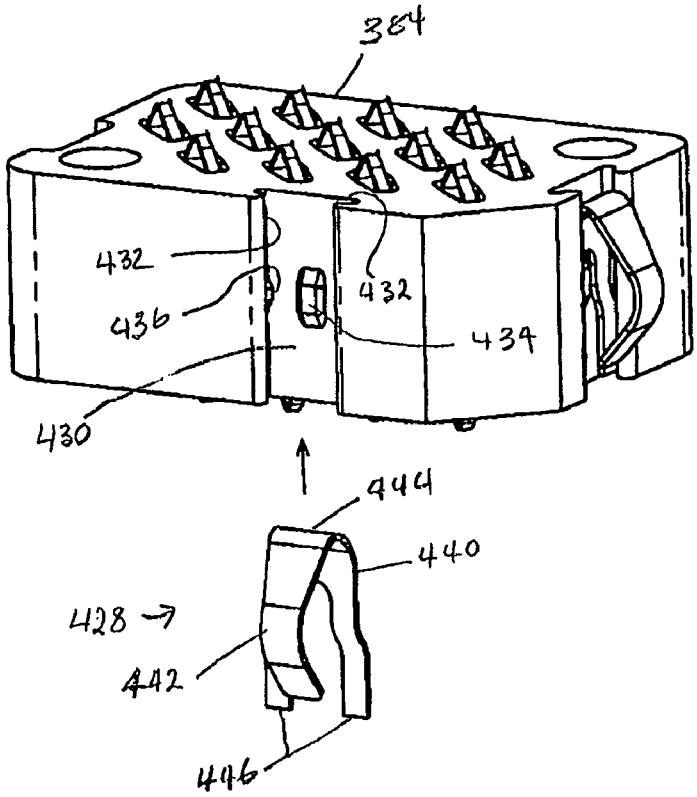
FIGURE 17-A
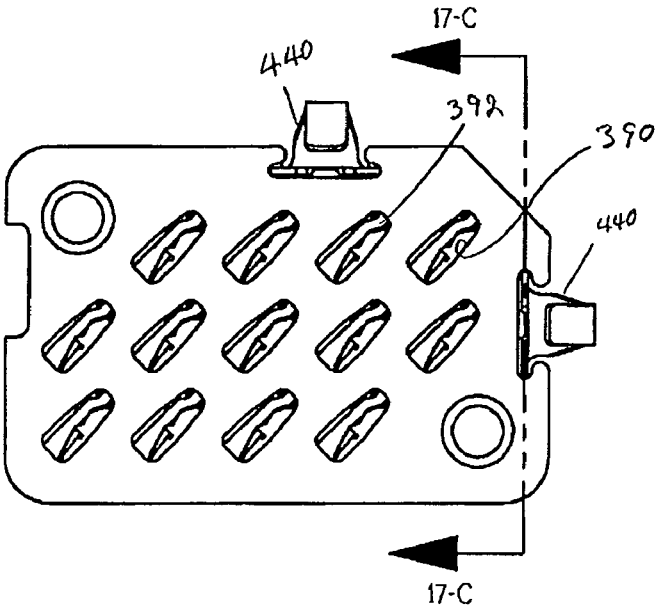
FIGURE 17-B
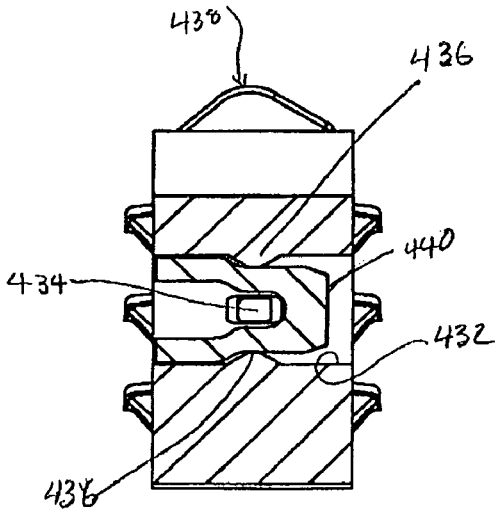
FIGURE 17-C

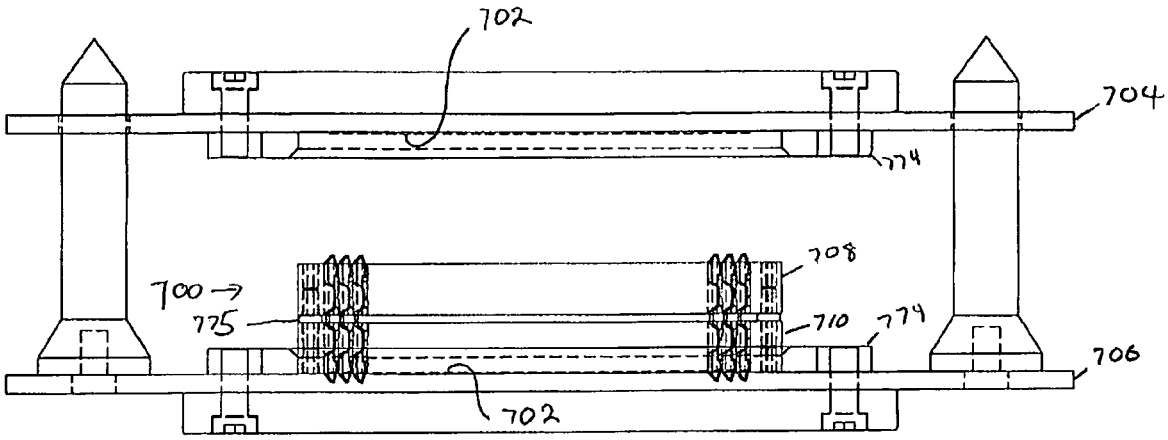
FIGURE 18-A
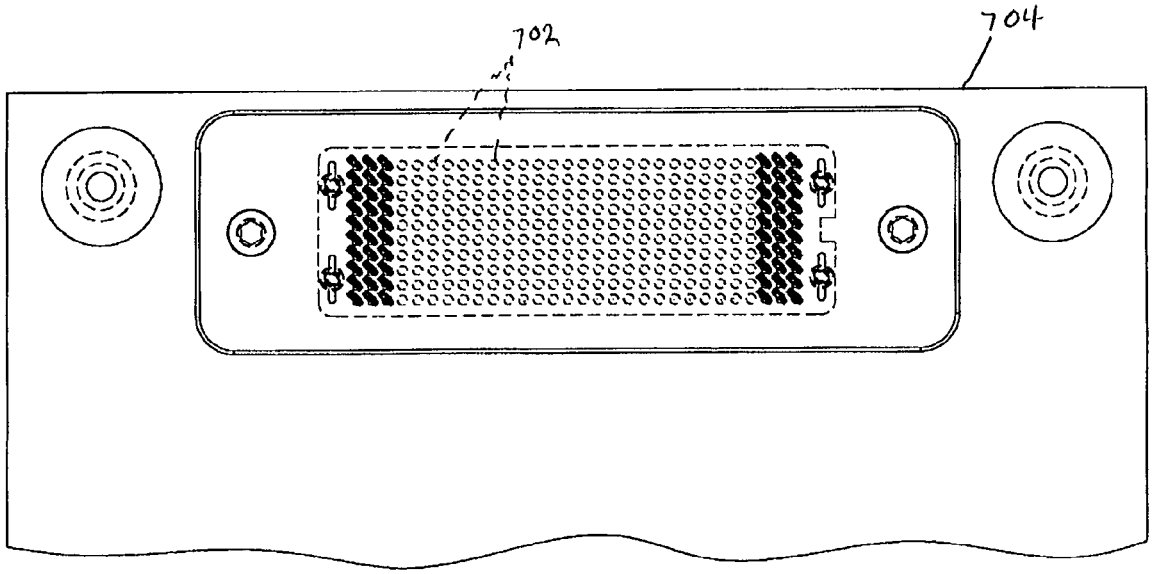
FIGURE 18-B

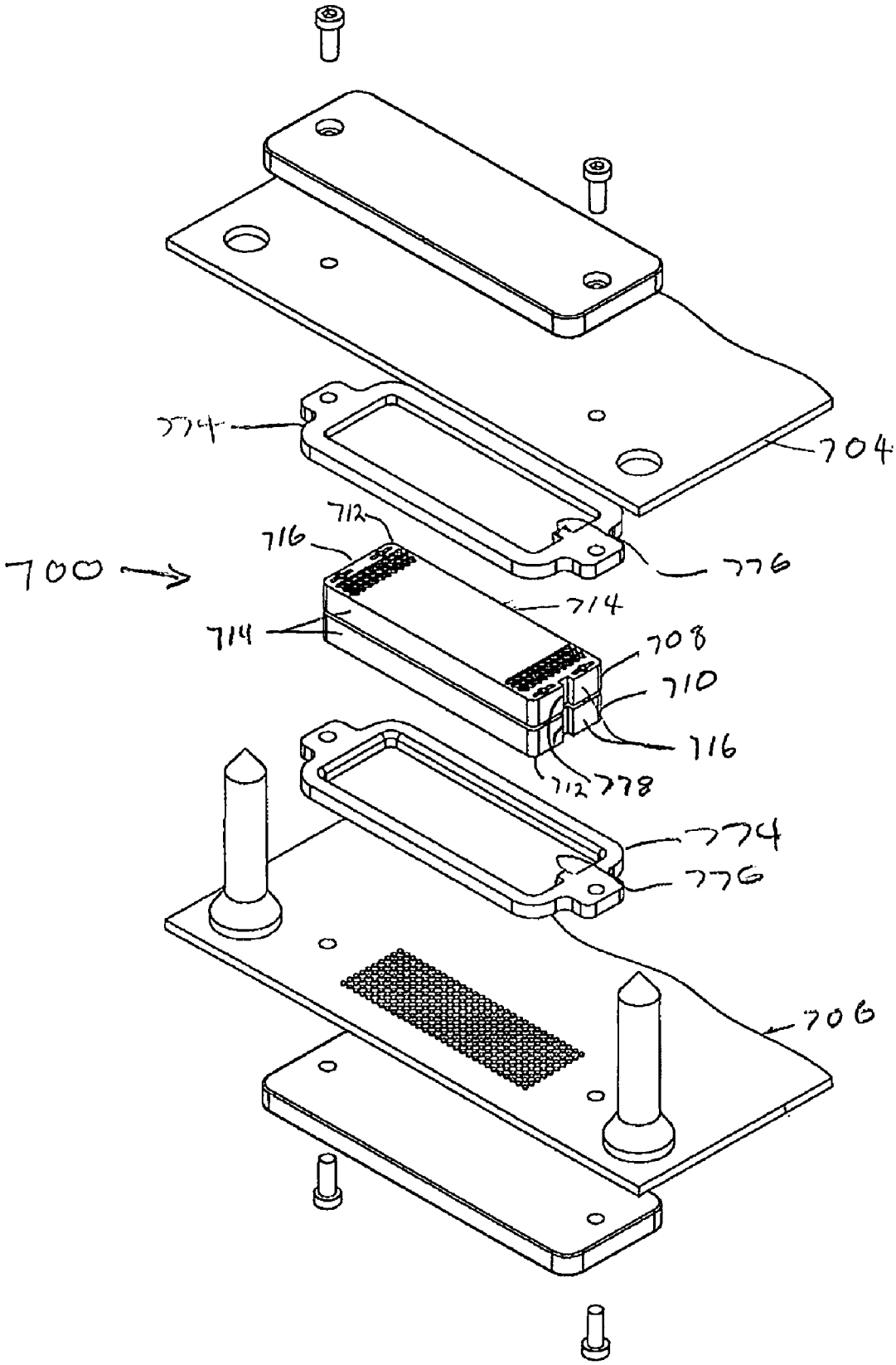
FIGURE 18-C

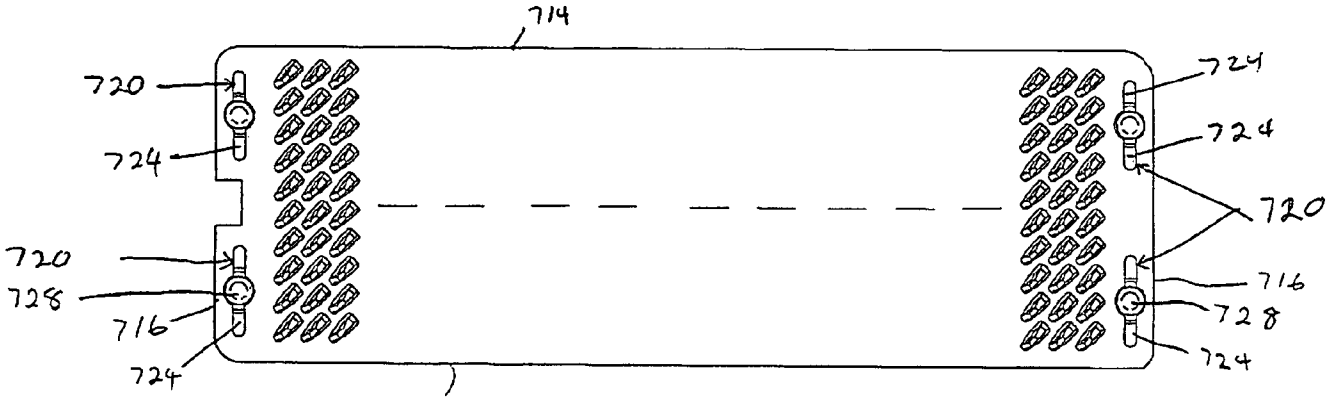
FIGURE 18-D
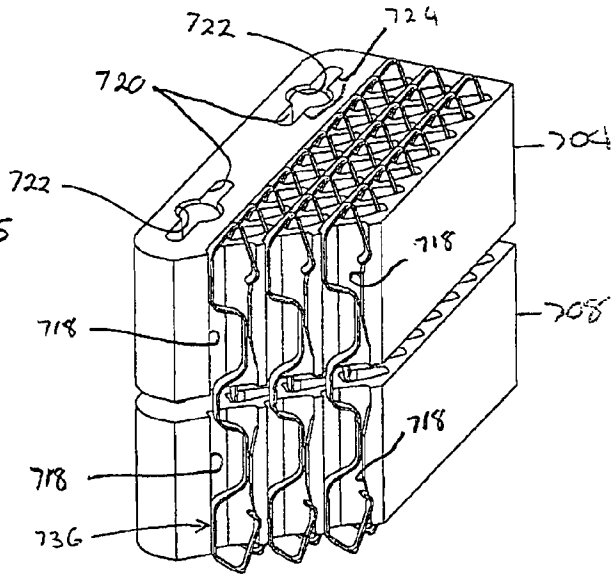
FIGURE 18-F
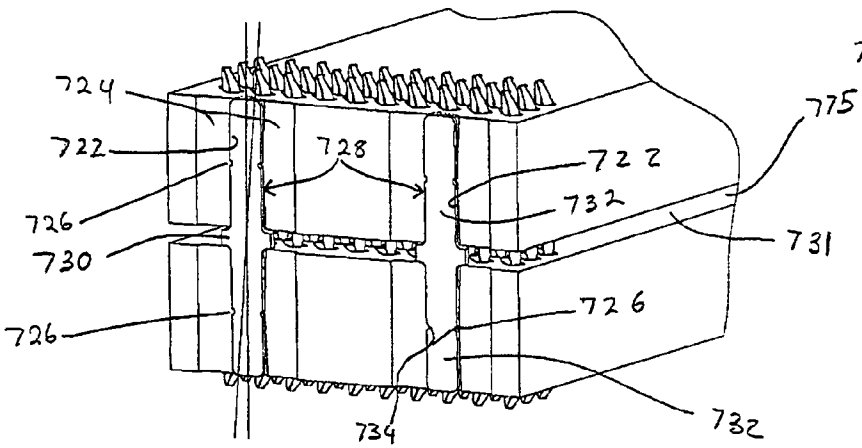
FIGURE 18-E

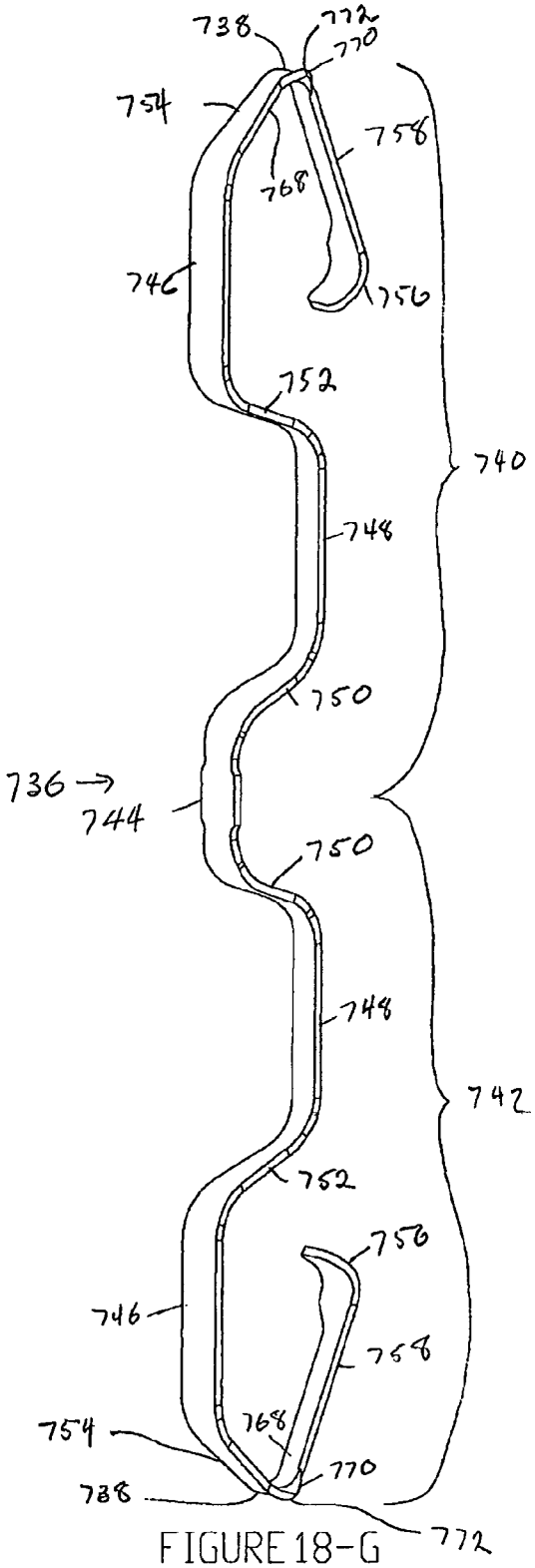
FIGURE 18-G
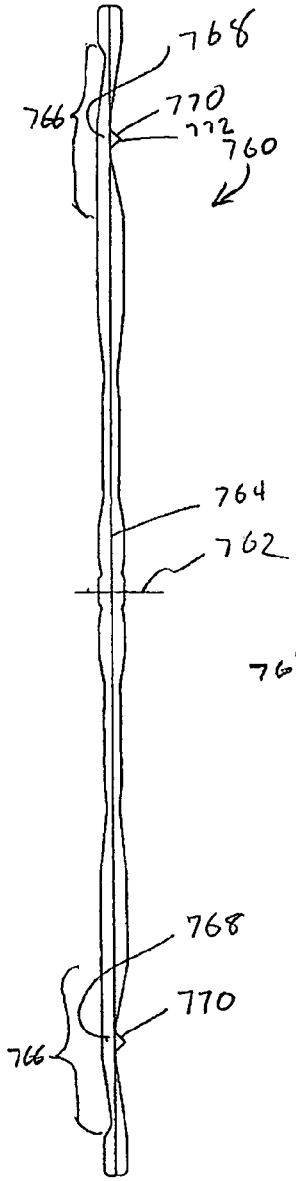
FIGURE 18-H
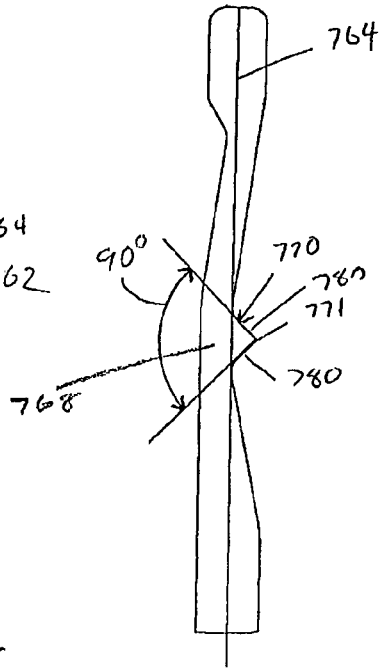
FIGURE 18-I

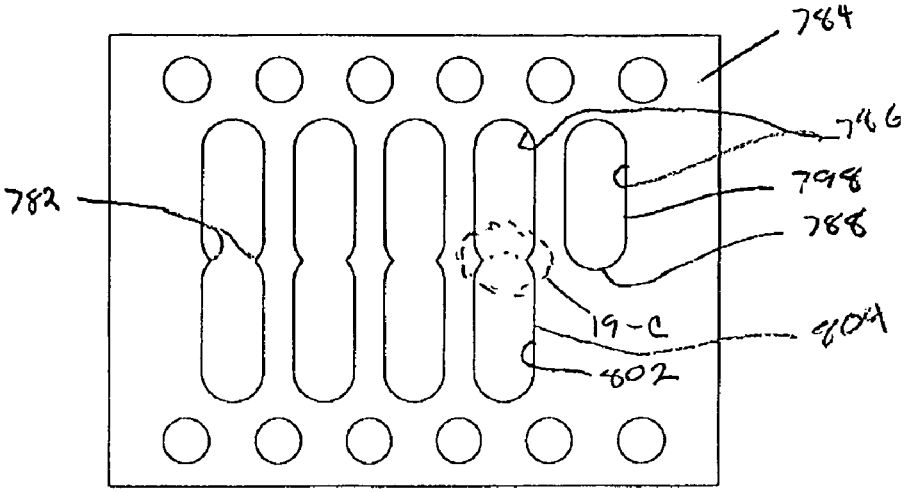
FIGURE 19-A
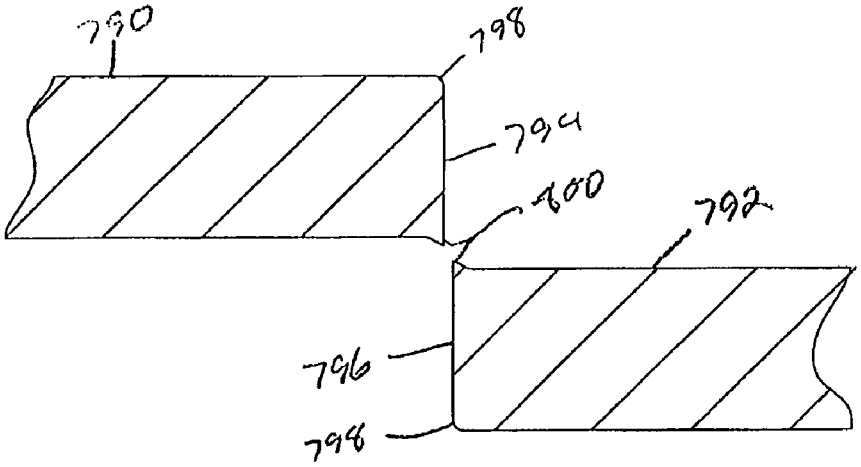
FIGURE 19-B
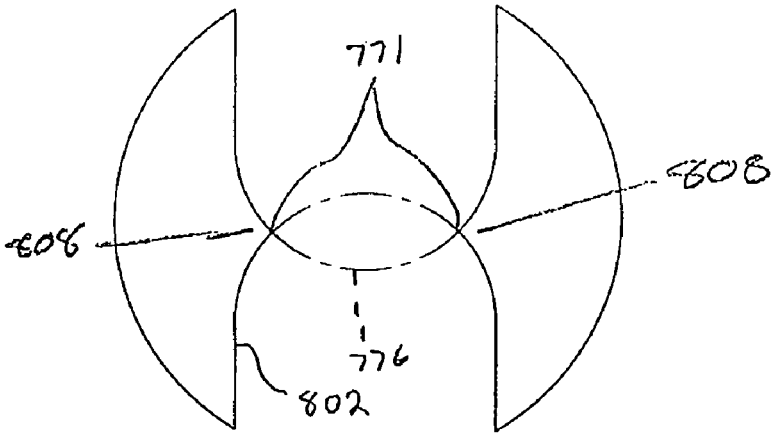
FIGURE 19-C

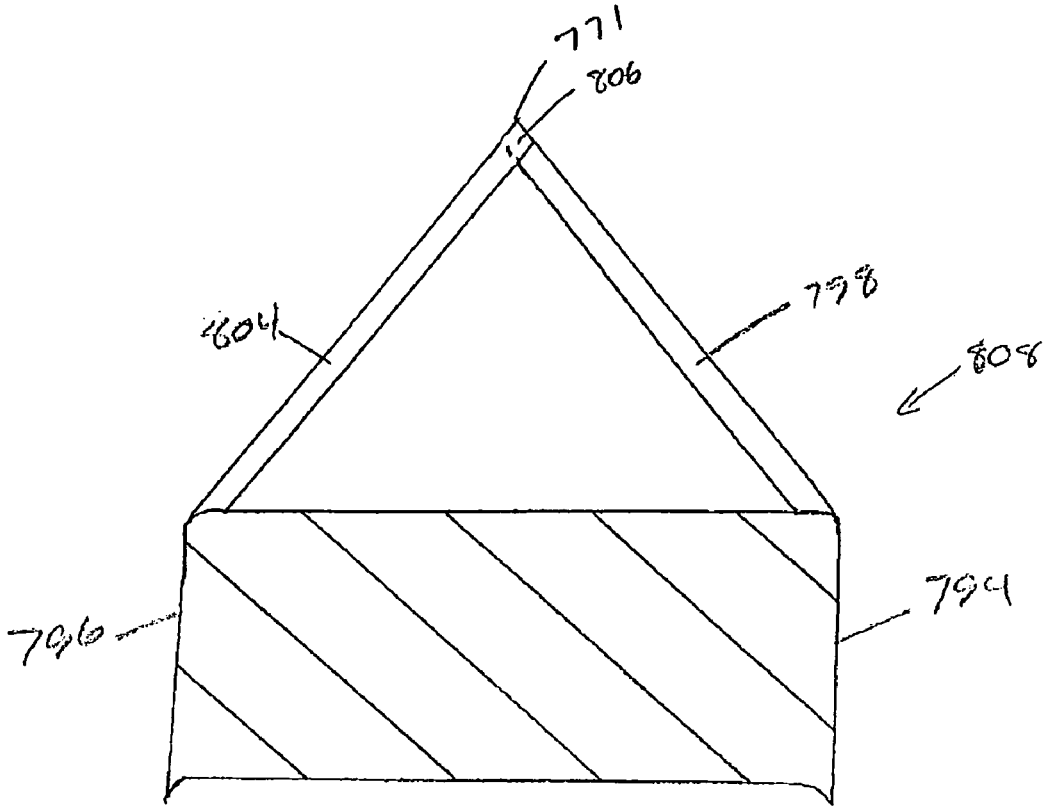
FIGURE 19-D
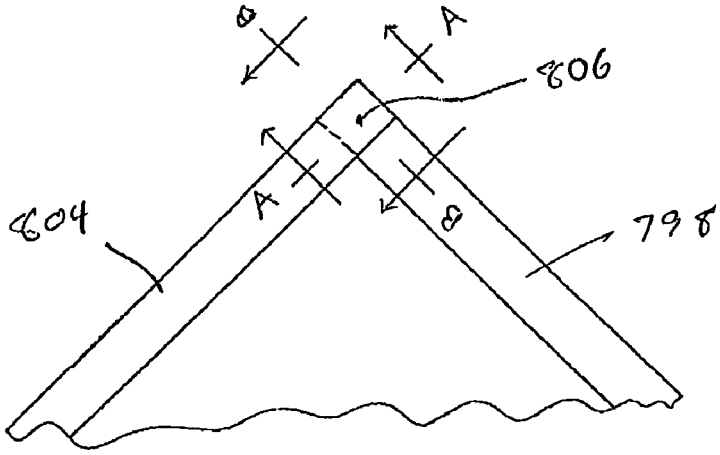
FIGURE 19-E
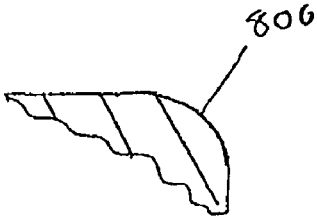
FIGURE 19-F
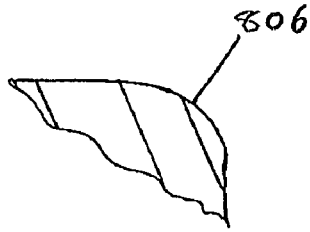
FIGURE 19-G

INTERPOSER ASSEMBLY AND METHOD

FIELD OF THE INVENTION

The invention relates to interposer assemblies for forming electrical connections between pads on opposed substrates, to very small contact tips for establishing electrical connections on pads and to elongate strip contacts with single contact tips located on the longitudinal axis of the contact.

BACKGROUND OF THE INVENTION

Conventional interposer assemblies are mounted on substrates by pins extending from the assemblies through holes on the substrates or by positioning the interposers in alignment collars mounted on the substrates. The connections between the interposer assemblies and the substrates have limited lateral compliance. This compliance permits use of the interposer assemblies for connecting substrates which are laterally offset a small distance only and permits limited shifting of the substrates in response to lateral forces after the interposer assembly has been mounted on the substrates.

In many applications, interposer assemblies are needed to establish and maintain continuous electrical circuit paths between contact pads on substrates with increased lateral compliance between the substrates. Increased compliance is needed because of possible large substrate offset when the interposer assemblies are installed. The substrates may be offset by an amount greater than can be accommodated by the limited lateral compliance provided by conventional interposer assemblies. Increased compliance is also needed because after an interposer assembly is mounted between two substrates, the substrates may be subject to lateral forces. Lateral forces should not stress mounted interposer assemblies or be transmitted from one substrate through a mounted interposer assembly to another substrate.

One interposer assembly according to the invention includes a top plate, which is mounted on a top substrate, a bottom plate, which is mounted on a bottom substrate, a shift interface between the plates and a plurality of electrical circuit paths extending through the plates and across the interface to contact surfaces on noses at the top of the top plate and at the bottom of the bottom plate. The circuit paths provide continuous electrical connections between pads on the substrates. The top and bottom plates shift laterally along the interface to provide greater lateral compliance than in conventional interposer assemblies.

The top and bottom plates may be secured together by pins. Vertical pins may extend through passages in the plates. The pins permit limited lateral movement of the plates so that the interposer assembly can be mounted on misaligned substrates. The pins permit the interposer assembly plates to move laterally along the interface in response to lateral forces exerted on the substrates.

Another interposer assembly according to the invention includes top and bottom plates and a central circuit board plate located between the top and bottom plates. The top and bottom plates are mounted on the substrates. Contact passages extend through each top and bottom plate with contacts fitted in the passages. Contact surfaces are provided on noses at the upper and lower sides of the top and bottom plates. Opposed pairs of pads are provided on the top and bottom surfaces of the central circuit board plate with metal conductors extending across the plate between top and bottom pads. The contacts on the top and bottom plates engage the pads on the circuit board plate at pressure connections. The three plates are held together by pins fitted in holes in the plates. The pins permit controlled lateral shifting of the plates at two shift interfaces.

In the disclosed interposer assemblies, top and bottom plates are mounted on the substrates using collars or pins with the contacts in the top plate engaging pads on the top substrate and contacts in the bottom plate engaging pads on the bottom substrate. Continuous electrical circuit paths extend through the assemblies to connect opposed pads on the substrates. In the two-plate interposer assembly, single contacts may be positioned in passages in both plates and form continuous metal circuit paths. In the three-plate interposer assembly, the circuit paths include contacts located in passages in the top and bottom plates, pads and conductors on the central circuit board plate and pressure electrical connections between the inner ends of the contacts and the pads on the circuit board plate.

Interposer assemblies having three plates and two shift interfaces have greater compliance than two-plate, one shift interface interposer assemblies to permit mounting on misaligned substrates and lateral shift of the substrates without transmitting forces between the substrates after the assemblies have been mounted between the substrates. Additionally, the height of the interposer assembly can be easily and inexpensively altered by varying the thickness of the central circuit board plate. Top and bottom plates may be identical.

The invention also relates to an elongate strip metal contact useful in interposer assemblies for forming electrical connections between spaced contact pads with a small, single contact tip on each end of the contact located on the end of a bent up tab on or very close to the longitudinal axis of the contact. Providing a single small contact tip located on a tab bent up from the contact at or adjacent to the longitudinal axis of the contact provides high-pressure contact engagement with pads. The central location of the contact tip with respect to the width of the contact assures that loading forces exerted on the contact by engagement with a pad extends essentially along the longitudinal axis of the contact to reduce off-center forces and prevent the compressed contact from binding in the contact passages in the interposer plates. The location of a tip on each bent up tab close to or on the longitudinal axis of the contact assures resiliency of the contacts and provides high-pressure connections with the overlying and underlying pads.

The tips on the tabs are at the intersection of two rounded shear corners on the tab and are exceedingly small. The reduced size of the contact tips increases contact pressure to improve electrical connections between the tips and pads.

BRIEF SUMMARY OF THE DRAWINGS

FIG. 1-A is an exploded view of a prior art interposer assembly between two substrates;

FIG. 1-B is a top view of the interposer assembly of FIG. 1-A;

FIG. 1-C is a sectional view taken along line 1-C-1-C of FIG. 1-B;

FIGS. 1-D, 1-E and 1-F are views similar to FIG. 1-C showing mounting of the interposer assembly on substrates;

FIGS. 1-G and 1-H are similar to FIG. 1-C illustrating different types of prior art interposer assemblies;

FIGS. 2-A, 2-B, 2-C, 2-D, 2-E and 2-F illustrate other prior art interposer assemblies mounted on substrates using surrounding collars on the substrates and correspond generally to FIGS. 1-A, 1-B, 1-C, 1-D, 1-E and 1-F;

FIGS. 3-A and 3-B are vertical sectional views through a two-plate interposer assembly with a sliding shift interface between the plates and alignment pins extending through the plates and overlying and underlying substrates;

FIGS. 4-A and 4-B are vertical sectional views like FIGS. 3-A and 3-B showing a two-plate interposer assembly with a spaced apart shift interface and alignment pins;

FIGS. 5-A and 5-B are vertical sectional views like FIGS. 3-A and 3-B showing a two-plate interposer assembly with a sliding shift interface and different pins;

FIGS. 6-A and 6-B are vertical sectional views like FIGS. 3-A and 3-B illustrating a two-plate interposer assembly with a spaced apart shift interface and different pins;

FIGS. 7-A, 7-B and 7-C illustrate a two-plate interposer assembly with a sliding shift interface and pins mounted in collars on the substrates;

FIGS. 8-A, 8-B and 8-C are similar to FIGS. 7-A, 7-B and 7-C and illustrate a two-plate interposer assembly with a spaced apart shift interface and plates fitted in collars on the substrates;

FIGS. 9-A, 9-B, 9-C, 9-D, 9-E and 9-F illustrate a two-plate interposer assembly with a spaced apart shift interface and different pins fitted in inserts in the plates;

FIGS. 10-A, 10-B, 10-C, 10-D and 10-E illustrate a two-plate interposer assembly with a spaced apart shift interface and alignment pins extending from one plate into a resilient insert in the other plate;

FIGS. 11-A, 11-B and 11-C illustrate a two-plate interposer assembly with spaced apart shift interface and coiled spring wire pins extending between the plates for lateral shift;

FIG. 11-D is a perspective view illustrating a two-plate interposer assembly with spaced apart lateral shift interface and coil pins extending across the interface adapted to be mounted in retention collars on overlying and underlying substrates;

FIG. 11-E is a perspective view illustrating a two-plate interposer assembly with spaced apart shift interface with wound coil pins at two diagonal corners and pins with spacer collars at the opposite diagonal corners, adapted to extend into alignment holes in overlying and underlying substrates;

FIG. 12-A is an exploded view illustrating a three plate interposer assembly with two sliding lateral shift interfaces, pins and overlying and underlying substrates with rectangular alignment collars;

FIG. 12-B is a top view of the interposer assembly of FIG. 12-A;

FIG. 12-C is vertical sectional view taken along line 12-C-12-C of FIG. 12-B;

FIG. 12-D is a view similar to FIG. 12-C showing lateral shift of the interposer assembly and substrates;

FIGS. 13-A and 13-B are views of a three-plate interposer assembly with two lateral shift interfaces, similar to the interposer assembly of 12-A and 12-B, but with a thicker central plate;

FIGS. 14-A and 14-B illustrate the ends of alignment pins used in the interposer assemblies of FIGS. 12-C and 12-D;

FIG. 15-A is an exploded view of a three-plate interposer assembly with two lateral shift interfaces and substrates;

FIG. 15-B is a side view, partially broken away, of the interposer assembly of 15-A mounted in alignment collars on the substrates;

FIG. 15-C is a view taken along 15-C-15-C of FIG. 15-B;

FIG. 15-D is a view similar to FIG. 15-C illustrating an interposer assembly using larger plates;

FIGS. 15-E and 15-F are sectional views taken along line 15-E-15-E of FIG. 15-C;

FIGS. 16-A and 16-B are views of an interposer assembly plate and spring clips inserted into the plate;

FIG. 16-C is a sectional view taken along line 16-C-16-C of FIG. 16-B;

FIGS. 16-D, 16-E and 16-F are views of the clip;

FIGS. 17-A, 17-B and 17-C are similar to FIG. 16-A, 16-B and 16-C but illustrate a plate using a different clip;

FIG. 18-A is a side view of a two-plate interposer assembly with a spaced apart lateral shift interface;

FIG. 18-B is a top view of FIG. 18-A;

FIG. 18-C is an exploded view of FIG. 18-A;

FIG. 18-D is a top view of a plate in the interposer assembly of FIG. 18-A;

FIGS. 18-E and 18-F are sectional views through the assembly of FIG. 18-A;

FIG. 18-G is a perspective view of a contact used in the assembly of FIG. 18-A;

FIG. 18-H is a view of a flat, stamped pre-form for the contact of FIG. 18-G;

FIG. 18-I is an enlarged view of one end of the pre-form of FIG. 18-H;

FIG. 19-A illustrates stamp-forming of the contact tip illustrated in FIG. 18-I;

FIG. 19-B illustrates shearing of strip stock to form sheared edges, rounded corners and sharp, drag corners;

FIG. 19-C is an enlargement of portion 19-C of FIG. 19-A.

FIG. 19-D is a view of a contact tip;

FIG. 19-E is a further enlarged view of the tip; and

FIG. 19-F and 19-G are sectional views taken along lines A-A and B-B of FIG. 19-E.

DESCRIPTION OF THE PRIOR ART

Interposer assemblies establish electrical connections between fields of contacts on opposed, parallel substrates. Conventional interposer assemblies include a single insulating plate with passages extending between top and bottom surfaces and contacts in the passages with contact noses at the top and bottom surfaces. The contacts are located in the same pattern as the pads on the substrates for establishing electrical connections between pairs of opposed pads. The interposer assemblies are mounted on the top and bottom substrates by pins or collars to position the contacts for engagement with the pads.

FIGS. 1-A to 1-H and 2-A to 2-F illustrate conventional one-plate interposer assemblies. FIGS. 1-A to 1-F illustrate a first prior art interposer assembly 10 for establishing electrical connections between fields of contact pads 12 on adjacent surfaces of opposed, parallel top and bottom substrates 14 and 16. The interposer assembly includes a single plate 18 having top surface 20 and bottom surface 22 and a series of contact passages 24 extending between the surfaces. Electrical contacts 26 are fitted in the passages and include contact surfaces or noses 28 normally extending above and below surfaces 20 and 22. Diagonally located alignment pins 30 are inserted into holes in the plate and extend above and below surfaces 20 and 22. The alignment pins 30 extend into alignment holes 32 in substrates 14 and 16 to orient the plate on the substrates.

FIG. 1-C illustrates assembly 10 located between substrates 14 and 16 with the noses 28 of each contact 26 in alignment with an opposed pair of pads 12 on the substrates 14 and 16 and pins 30 located in alignment with holes 32.

As substrates 14 and 16 are moved together, pins 30 are piloted into holes 32, the contact noses 28 engage pads 12 and the contacts are compressed to form continuous electrical circuit paths between opposed pairs of pads 12 as illustrated in FIG. 1-E.

Holes 32 are made slightly larger than pins 30 so that lateral forces 34 exerted on substrates 14 and 16 can move the substrates laterally slight distances as illustrated in FIG. 1-F. Contact noses 28 maintain electrical connections with pads 12, despite limited lateral shifting of the substrates and flexing of the contacts. Typically, plate 18 is free to move laterally about 0.002" at the pin/hole connections between the plate and each of the upper and lower substrates. These connections allow a maximum lateral shift or compliance between the top and bottom substrates about 0.004" in any direction in the planes of the substrates. The size of the shift is exaggerated in the drawings. The lateral compliance permits mounting the assembly 10 between slightly misaligned top and bottom substrates and also permits slight lateral shifting of the substrates after the interposer assembly has been mounted between the substrates as in FIG. 1-F in response to forces 34 exerted on the substrates.

The one-plate prior art interposer assembly 36 of FIG. 1-G is like assembly 10 with the exception that alignment pins 38 are the end portions of elongate pins 40 fitted in bores 42 extending through the thickness of plate 44. Pins 38 fit into slightly enlarged holes 46 in the underlying and overlying substrates. The fit of pins 38 in holes 46 permits limited lateral offset and movement of the substrates as previously described.

The one-plate prior art interposer assembly 48 of FIG. 1-H is like assembly 36 with the exception that pins 50 are integrally molded parts of plate 54. The pins are slightly smaller than holes 52 in the overlying and underlying substrates permitting limited lateral offset and movement of the substrates as previously described.

FIG. 2-A illustrates prior art interposer assembly 56 including one plate 58, passages 60 extending through the plate and contacts 62 located in the passages. The interposer assembly is mounted on upper and lower substrates 64 and 66 by rectangular alignment collars 68 and 69 mounted on the substrates. The collars orient the plate 58 on the substrates so that contacts engage pads on the substrates as previously described. There is a small clearance between plate 58 and each collar 68 and 69 which permits mounting the assembly on slightly offset substrates and permits limited lateral shifting of the substrates after the interposer assembly 56 has been mounted on the substrates, as previously described. This lateral shift is about 0.002" at each circuit board with a total available shift of 0.004" between substrates.

In conventional interposer assemblies, the fits between the plates and pin holes or collars typically permit lateral movement of 0.002" at the top and at the bottom of each plate for a total lateral compliance of about 0.004" in directions parallel to the plane of the substrates.

DESCRIPTION OF THE PREFERRED EMBODIMENTS

Interposer assembly 70 shown in FIGS. 3-A and 3-B forms electrical connections between opposed pads on upper and lower substrates 74 and 76. Assembly 70 includes top plate 78, bottom plate 80, and a sliding interface 82 between the plates. Contact passages 84 extend between the upper and lower sides of plates 78 and 80 and continuous metal strip contacts 86 are positioned in aligned pairs of passages 84 and extend across sliding interface 82.

The upper and lower plates 78 and 80 are rectangular with vertical pin holes 88 extending between the upper and lower sides of each plate at opposed diagonal corners. Pin retention collars 90 extend inwardly from holes 88 approximately midway between the top and bottom sides of the plates. Cylindrical alignment pins 92 extend through aligned holes 88 and collars 90. The pins have tapered upper and lower ends 94 which extend into alignment holes 96 in the upper and lower substrates 74, 76. The pins are smaller than holes 88 and 96 Collars 90 are slightly larger than pins 92 to permit limited rotation of the pins in holes 88 during lateral shift of the substrates and plates as shown in FIG. 3-B.

Interposer assembly 70 is mounted on spaced apart substrates 74 and 76 by extending pin ends 94 into holes 96 and then applying a clamping force to the substrates to move the substrates over the pin ends as shown in FIG. 34, and compress the contacts 86 so that the contact surfaces at the ends of the contacts establish pressure electrical connections with pad 72.

Pins 92 are preferably formed from metal and include formed retention projections 102 which may be like the projections formed on the pin illustrated in FIG. 7-C. The projections 102 may be formed by compressing opposed sides of the pin inwardly to extrude metal on opposite sides of the pin outwardly from the pin. The projections 102 at each end of the pins have a maximum spacing greater than the interior diameter of collars 90. Pins 92 are inserted into the pin holes 88 of aligned plates 78 and 80 with the lead projections 102 snapped past retention collars 90 so that the pins hold the assembly together yet permit lateral shifting of the plates as illustrated in FIG. 3-B.

Pins 92 are free to pivot in any direction in holes 88 to accommodate horizontal misalignment or lateral shift of the substrates 74 and 76. Electrical connections are maintained between the pads 72 on the substrates and the contacts in the interposer assembly by a conventional clamp mechanism, which biases the substrates toward each other to compress contacts 86.

Lateral movement of plates 74 and 76 pivots pins 92 in holes 88. FIG. 3-B illustrates interposer assembly 70 with the pins engaging the upper and lower edges of holes 88 after maximum lateral shift of the plates in response to lateral forces 98. Lateral movement of plates 74 and 76 in response to forces 98 may move the contact noses 100 across passages 84 while retaining electrical connections between contact surfaces on the noses and the pads 72. The plates move laterally a distance of about 0.004" at the interface to increase the compliance of the assembly.

FIGS. 4-A and 4-B disclose interposer assembly 104 for forming electrical connections between opposed pairs of pads 106 on upper and lower substrates 108 and 110. The assembly includes top and bottom plates 112 and 114, like plates 78 and 80, and alignment pins 116 extending through the holes in the plates. Pins 116 include central spacer rings 118 located between the bottom surface 120 of top plate 112 and the top surface 122 of bottom plate 114. The height of the rings 118 along pins 116 may be varied to adjust the height of the interposer assembly 104 according to the desired spacing between substrates 108 and 110. Spacers 118 separate surfaces 120 and 122 to provide an open lateral shift interface 124 between the plates.

FIG. 4-B illustrates the application of lateral forces 126 on substrates 108 and 110 to shift the substrates laterally and rotate pins 116 in the pin holes in plates 112 and 114. The top and bottom surfaces of rings 118 are flat so that rotation of the rings increases the separation between the plates at a short distance at interface 124. The clamp force holding the substrates against assembly 104 is compliant and permits limited separation between the plates in response to lateral shift. If desired, the spacer rings 118 could include top and bottom spherical surfaces seated in spherical recesses in the adjacent plate surfaces to maintain spacing of the plates during lateral shift.

FIGS. 5-A and 5-B illustrate another interposer assembly 128 similar to assembly 70 shown in FIG. 3-A for forming electrical connections between opposed pairs of pads 130 on upper and lower substrates 132 and 134. Assembly 128 includes top and bottom plates 136, 138 with pin holes 140 extending through the plates like holes 88 and pin retention collars 142 like collars 90 with the exception that the interior surfaces of the collars are tapered inwardly to a circular pin pivot line 144. Retention pins 145 are cylindrical and similar to pins 92 with the exception that the pins are not provided with projections 102 but include annular recesses 146 at each collar 142. The diameter of the pin away from recesses 146 is slightly greater than the interior diameter of lines 144. The pins are preferably formed from metal and are inserted into the pin holes 140 and ride past collars 142 until the collars are located in the recesses 146 as illustrated. The collar-recess engagement between the pins and the plates holds assembly 128 together and permits lateral shifting of the assembly as illustrated in FIG. 5-B. The plates 136 and 138 include contact cavities 148 which receive strip metal contacts 150. Contacts 150 form continuous electrical circuit paths between opposed pairs of pads 130 despite lateral shifting of the plates in directions parallel to the substrates. Interposer assembly 128 has a sliding lateral shift interface 152 between the upper and lower plates. Contacts 150 extend across the interface.

Interposer assembly 154 shown in FIGS. 6-A and 6-B establishes electrical connections between opposed pairs of contact pads 156 on upper and lower substrates 158 and 160. The interposer assembly 154 includes top and bottom plates 162 and 164, contact passages, pin holes and pin retention collars as in plates 136 and 138 illustrated in FIG. 5-A. Contacts 166 are fitted in the contact passages to maintain electrical connections between opposed pairs of pads 156. Alignment pins 168 extend through the pin holes and engage the retention collars on the plates as previously described. The pins 168 include central spacer rings 170, like rings 118, between the plates 162 and 164. The spacer rings 170 vary the height of the interposer assembly 154 in accordance with the required spacing between the substrates. Interposer assembly 154 has an open lateral shift interface 172 between plates 162 and 164. FIG. 6-B illustrates lateral shift of interposer assembly 154 in response to lateral forces 174 exerted on the substrates 158 and 160.

FIGS. 7-A, 7-B and 7-C illustrate interposer assembly 176 for forming electrical connections between contact pads 178 on upper and lower substrates 180 and 182. Assembly 176 is like assembly 70 shown in FIG. 3-A, with the exception that with the ends of alignment pins 184 are recessed a slight distance below the top surface of top plate 186 and a slight distance below the bottom surface of the bottom plate 188. Rectangular alignment collar 190 is mounted on upper substrate 180. Rectangular alignment collar 192 is mounted on the lower substrate 182. Plates 186 and 188 have a slight loose fit within collars 192. This loose fit in the collar is not sufficient to move the noses of the contacts held in the passages in the plates from pads 178. As illustrated in FIG. 7-C, the alignment pins include extruded projections 194 to either side of formed recesses 196. The projections extend beyond the pin retention collars 198 in holes 200 to retain plates 186 and 188 together in the assembly. Assembly 176 has a sliding lateral shift interface 201 between the plates.

FIGS. 8-A, 8-B and 8-C illustrate interposer assembly 202 for forming electrical connections between opposed pairs of pads 204 on upper and lower substrates 206 and 208. The interposer assembly 202 is similar assembly 176 illustrated in FIG. 7-A with the exception that the alignment pins 210 include central spacer rings 212. The spacer rings can vary the height of assembly 202 according to the distance between substrates 206 and 208, as previously described. Interposer assembly 202 has an open lateral shift interface 214 between top plate 216 and bottom plate 218.

FIGS. 9-A, 9-B, 9-C, 9-D and 9-F illustrate interposer assembly 220 for forming electrical connections between opposed pads 222 on upper and lower substrates 224 and 226. The interposer assembly includes top and bottom plates 228 and 230, positioned in alignment collars 232 and 234 mounted on the upper and lower substrates. The collars are like collars 190 and 192 disclosed in FIG. 7-A. Assembly 220 includes alignment pins 236 at opposite diagonal corners of the plates. Each pin 236 includes a spherical end 238 fitted a spherical recess 240 in resilient insert 242, illustrated in FIGS. 9-C, 9-D, 9-E and 9-F. Insert 242 may be made from a resilient plastic resin to permit snap fitment of pin ends 238 in recesses 240. Inserts 242 are fitted in passages 244 extending through plates 228, 230.

The pivot connections between the ends of the pins and the sockets permit lateral shift of the plates 228, 230 in directions parallel to the planes of the substrates, as illustrated in FIG. 9-B. Interposer assembly 220 has an open lateral shift interface 246 between plate 228 and 230.

FIGS. 10-A, 10-B, 10-C, 10-D and 10-E illustrate interposer assembly 248 for forming electrical connections between opposed pads 250 on upper and lower substrates 252, 254. The assembly includes top and bottom plates 256 and 258 positioned in alignment collars 260 and 262 mounted on the substrates. The plates include contacts and contact passages as previously described.

The plates are joined together by two metal cylindrical alignment pins 264. The upper ends of the pins are press-fitted into pin holes 266 extending through top plate 256. The lower ends 267 of pins 264 extend into the centers of elastomeric inserts 268. Inserts 268 are press-fitted into insert holes 270 extending through bottom plate 258.

As illustrated in FIGS. 10-C, 10-D and 10-E, inserts 268 include a cylindrical body 272, a flange 274 extending outwardly from the top of the body and a central pin receiving recess 276 extending downward from the flange into the body. Resilient vertical ribs 278 extend into the recess. The spacing between opposed ribs is slightly less than the diameter of pin 264. Flanges 274 maintain spacing between plates 256 and 258. The height of the flanges may be increased to increase the height of interposer assembly 248 as required by the spacing between the substrates. Interposer assembly 248 has an open lateral shift interface 280 between the plates. The plates include contact passages and contacts in the passages, as previously described.

The plates 256 and 258 are secured together by extending the lower ends of pins 264 into recesses 276. The pins frictionally engage the ribs 278. Lateral forces exerted on the substrates bias the pins against and compress ribs to permit lateral shift, as illustrated in FIG. 10-B. Flange 274 positions the inserted insert on bottom plate 258 and forms a spacer between the plates. As illustrated in FIG. 10-B, interposer assembly 248 has an open lateral shift interface 280 between plates 256 and 258.

FIGS. 11-A, 11-B and 11-C illustrate interposer assembly 282 for forming electrical connections between pads 284 on upper and lower substrates 286 and 288. Interposer assembly 282 includes top and bottom plates 290 and 292 with contact passages and contacts fitted in the passages, as previously described. The plates are secured together in the assembly by wound spring wire pins 294. Each spring wire pin includes upper and lower ends 296 and increased diameter central portion 298 between ends 296. Ends 296 are fitted in pin holes 300 in the plates. Metal alignment pins 302 are fitted in the opposite ends of holes 300 for mounting the plates on the substrates, as previously described. The enlarged center pin portion 298 engages the adjacent recess 299 in plates 290, 292 to retain the plates on the pins and maintain spacing between the plates. The length of portions 298 may be varied to vary the height of the assembly according to the spacing between the substrates. Assembly 282 has an open lateral shift interface 303.

FIG. 11-C illustrates lateral shifting of interposer assembly 282 by flexing of the spring wires in the central portions 298 of wound spring wire pins 294.

FIG. 11-D illustrates interposer assembly 304 like assembly 282 with the exception that pins 302 are removed. Assembly 304 is mounted on the upper and lower substrates by alignment collars, rather than by pins 302, as previously described.

FIG. 11-E illustrates interposer assembly 306 which is like interposer assembly 282 with the exception that assembly 306 includes continuous metal alignment pins 308 extending through pin holes in the diagonal corners of the top and bottom plates away from the wound spring wire pins 310. Pins are not provided above and below the wound spring wire pins. Spacing collars 312 are provided on pins 308. The pins 308 extend through enlarged pin holes in the upper and lower plates and are aligned in the center of the holes by pin retaining collars, like collars 90 illustrated in FIG. 4-A. The collars 312 provide spacing between the plates. The height of the collars may be adjusted to vary the height of assembly 306 as required by the spacing of the substrates.

FIGS. 12-A, 12-B, 12-C and 12-D illustrate interposer assembly 314 for forming electrical connections between opposed pads 316 on upper and lower substrates 318, 320. Interposer assembly 314 includes top plate 322, central circuit board plate 324 and bottom plate 326. Contact passages 328 extend across plates 322 and 326. Resilient strip contacts 330 are located in passages 328. The central circuit board plate 324 includes opposed pairs of contact pads 332 on the top and bottom surfaces thereof, and metal electrical conductors 334 connecting aligned pairs of pads 332. Plate 324 may be of conventional circuit board construction with an insulating body 336 supporting the pads 332 and conductors 334.

Assembly 314 is held together by two alignment pins 338 located on opposed diagonal corners of the assembly. Pins 338 extend through pin holes 340, 342 and 344 in plates 322, 324 and 326. Pin retention collars 346 like collars 90 in FIG. 3-A, extend inwardly at the centers of holes 340 and 344. The pins 338 have a close fit with collars 346. Projections 348 like projections 102 shown in FIG. 3-A, are formed on the ends of the pins outside of collars 346 to retain the plates in place on the pins, as previously described.

The top and bottom plates 322, 326 are mounted in alignment collars 350 and 352 on substrates 318, 320. The alignment collars are like collars 190, 192 illustrated in FIG. 7-A.

FIG. 12-D illustrates lateral shift of assembly 314 in response to lateral forces 354 exerted on the substrates. Forces 354 shift upper plate 322 to the right, lower plate 326 to the left, to the extent permitted by the freedom of movement of pins 338 in the pin holes 340, 342 and 344. As illustrated in 12-D, lateral shift of assembly 314 in response to forces 354 shifts top plate 322 laterally to the right relative to center circuit board plate 324 and shifts bottom plate 326 relatively to the left, relative to the center circuit board plate. Lateral shift between plates 322 and 324 occurs at shift interface 354. The lateral shift between plates 324 and 326 occurs at lateral shift interface 356 between the plates. During lateral shift of the plates, contacts 330 maintain electrical connections with the pads 316 on the substrates and pads 332 on the central circuit board plate 324. Shifting of the plates may move the contacts 330 in passages 328. Shifting may wipe the contacts across the pads, without interrupting the electrical connections between the pads on the substrates 318, 320.

The interposer assemblies described herein establish continuous electrical circuit paths between opposed pairs of pads on upper and lower substrates. These connections are maintained despite lateral misalignment and lateral shifting of the substrates. In two-plate interposer assemblies, the continuous circuit paths are established by one-piece flexible strip contacts extending across the shift interface. In interposer assembly 314, the electrical connections between pads 316 each include metal contacts in the top and bottom plates, pads on the top and bottom of the central circuit board plate and a metal conductor extending through the central circuit board plate between the pads, pressure connections 315 between the contacts and the substrate pads, and pressure connections 317 between the contacts and the plate pads. The continuous electrical circuit paths extend across the lateral shift interfaces between adjacent plates.

The interposer assembly 314 includes two shift interfaces 354, 356 and, correspondingly, has twice the lateral compliance of a two-plate interposer assembly having a single lateral shift interface. Increased compliance of interposer assembly 314 permits mounting the assembly on substrates further out of alignment than substrates connected by an interposer assembly with a single lateral shift interface. The increased compliance permits an installed interposer assembly to accommodate greater lateral shift of the top and bottom substrates.

FIGS. 13-A and 13-B illustrate three-plate interposer assembly 358 which is identical to assembly 314 with the exception that the central circuit board plate 360 has a greater height than plate 324. An increase in the height of plate 360 increases the height of the entire assembly to facilitate mounting between top and bottom substrates 362 and 364 which are spaced apart a distance greater than the spacing between substrates 318 and 320. The height of the central circuit board plate 360 and pins may be easily and inexpensively varied to permit use of the interposer assembly in different applications where the substrates have different spacing. Identical top and bottom plates may be used with different thickness center circuit board plates. Assembly 358 has two open lateral shift interfaces 370 and 372, as previously described.

FIGS. 14-A and 14-B illustrate the formed ends of the alignment pins 338 used in interposer assemblies 314 and 358. Similar pins may be used in other interposer assemblies. The pins 338 include projections 371 extending outwardly from the body of the pins. The opposed projections 371 are formed by forcing opposed tools against the pin ends to form opposed recesses 373 and bow the sides of the pin between the recesses outwardly to form projections 371.

FIGS. 15-A, 15-B, 15-C, 15-E and 15-F illustrate three-plate interposer assembly 374 for forming electrical connections between opposed pairs of pads 375 on upper and lower substrates 376 and 378. Assembly 374 includes top plate 380, central circuit board plate 382 and bottom plate 384. Alignment pins 386 extend through pin holes 388 in opposed corners of the plates. Contact passages 390 extend through plates 380 and 384. Contacts 392 are located in passages 390. The components of interposer assembly 374 are like the components of interposer assembly 358, previously described.

Assembly 374 is mounted between top and bottom substrates 376 and 378, which, like all substrates disclosed herein, may be circuit boards. The top and bottom plates 380, 384, are fitted in alignment collars 404 and 406 mounted on adjacent surfaces of the substrates. The collars surround the fields of pads 375. The fields of pads are formed on the substrates in the pattern of the contacts 392 in plates 380 and 384 and the pads on plate 382.

Plates 380 and 384 are alike and include a dielectric body defining the contact passages 390. The spring contacts 392 are formed from strip metal and include contact noses normally extending above the top and bottom surfaces of the plates 380 and 384. The plates 380 and 384 and the other plates discussed in this application may be of the types disclosed in U.S. Pat. Nos. 6,176,707, 6,217,342, 6,315,576, 6,290,507, 6,730,134 and 6,905,343, assigned to Amphenol Corporation of Wallingford, Conn., USA, assignee of the present application. Other types of plates and contacts may be used, if desired.

Central circuit plate 382 is like plate 324 illustrated in FIG. 12-C and includes a dielectric body with flat opposed top and bottom surfaces with fields of electrical contact pads on the surfaces (not illustrated), arranged in the pattern and spacing of substrate pads 375. Metal conductors (not illustrated), which may be plated through holes, extend between pairs of spaced pads on the top and bottom surfaces of plate 382. The plate may be a conventional circuit board. The plate may have a thickness depending upon the spacing between substrates 376 and 378.

The contacts, pads, conductors and pressure electrical connections form continuous electrical circuit paths between opposed pairs of pads 377 on substrates 376 and 378.

As illustrated in FIG. 15-C, the contacts 392 are arranged in rows extending longitudinally along plate sides 394 and 396, between plate ends 398 and 400. Diagonal orienting surface 402 extends across one corner of plate 384 at the junction of side 396 and end 400. The plates 380 and 382 have sides, ends and orienting surfaces corresponding to the above-described sides, ends and surface. Alignment collars 404 and 406 have diagonal orienting walls 408 at one corner to facilitate proper orientation of the top and bottom plates in the collars as illustrated in FIG. 15-C.

Alignment collars 404 and 406 each have side walls and end walls spaced apart distances slightly greater than the width and length of the top and bottom plates 380 and 384. As a result, plates 380 and 384 have loose fits in the collars.

Each plate 380 and 384 includes a single spring clip pocket 410 on the plate end adjacent to the orienting surface 402 and a single spring clip pocket 412 on the side adjacent the orienting surface 402.

FIG. 16-A shows plate 384 inverted from the positions of FIGS. 15-A and 15-B. Each pocket 410, 412 extends from the top surface of the plate to a blind end and includes opposed interior grooves 414. A metal spring clip 416 is positioned in each pocket. Clip 416 is generally U-shaped and includes a flat base 418 and a cantilever contact arm 420 connected to the base at reverse bend 422. The base includes two spaced arms 424 with outwardly facing retention barbs 426. The spring clip is inserted into pocket 412 as illustrated in FIG. 16-A. Arms 424 extend into grooves 414. Barbs 426 engage the bottoms of the grooves to retain the clips in the pockets. The cantilever arms 420 extend outwardly from the adjacent side or end of the plate.

FIGS. 17-A and 17-B illustrate a second embodiment metal spring clip 428. Metal spring clip 428 is fitted in pocket 430 from either side of the plate. Pocket 430 includes interior grooves 432 extending across the height of the plate. A central projection or bump 434 extends into the pocket 430. Side stops 436 are provided in grooves 432 midway between the top and bottom surfaces of the plate. The clip includes a flat base 440, cantilever contact arm 442, reverse bend 444 connecting the arm to the base and spaced arms 446. The width of the arms 446 is greater than the width of base 440. When clip 428 is inserted into pocket 430 from either side of the plate, the base 440 rides over the projection 434 and then falls back against the bottom of the pocket. At the same time, the outer diagonal sides of arms 446 engage side stops 436 to lock the clip in place in the pocket. See FIG. 17-C.

During mounting of interposer assembly 374 on substrates 376 and 378, plate 380 is inserted into alignment collar 404 and plate 384 is inserted into alignment collar 406 with diagonal surfaces 402 adjacent diagonal walls 408 to assure proper orientation of the assembly. During insertion, the two spring clips in each plate 380, 384 bias the plates against the opposing sides of the collars so that the plates are held in desired orientations within the collars and the contacts in the plates are properly positioned over the contact pads 375 on the substrates.

FIG. 15-D is a view similar to FIG. 15-C but illustrates a larger plate 448 for use in interposer assemblies for forming a larger number of circuit paths between substrates. Four spring clips 450 are mounted in pockets spaced along one long side of plate 448 and a single spring clip is mounted at the short end of the plate. When the plate 448 is positioned in the alignment collar as illustrated, the clips bias the plate against opposing walls of the collar to locate the contacts in the plate in proper position for engaging pads on substrate 454.

Interposer assembly 374 is mounted in alignment collars 404 and 406 between substrates 376 and 378 as described in connection with prior embodiment interposer assemblies. The contacts 392 in plates 380 and 384 make pressure electrical connections with the pads 375 on the substrates. The contacts also make pressure electrical connections with pads on the top and bottom surfaces of central circuit board plate 382. The pads on plate 382 are connected by conductors extending through the height of the plate. As a result, the interposer assembly forms continuous electrical circuit paths between aligned pads on the substrates. Each path includes a contact in upper plate 380, two pads and a conductor joining the pads in the central plate 382 and pressure connections at the ends of the contacts in the upper and lower plates and adjacent pads. A conventional clamp (not illustrated) holds the substrates 376 and 378 together to elastically stress contacts 392 and form the pressure electrical connections with the adjacent pads. The substrates may contact the plates 404 and 406 or may be spaced from the plates.

Interposer assembly 374 accommodates lateral misalignment between substrates and a lateral shifting of the substrates after installation between the substrates. Pins 386 limit lateral shifting of the three plates at the two lateral shift interfaces 456 and 458, as previously described. See FIGS. 15-A and 15-F. During lateral shifting, top plate 380 is shifted laterally relative to center plate 382 and bottom plate 384 is shifted laterally in the opposite direction relative to center plate 382. Plate 382 does not shift. The pins 386 are retained in assembly 374 by rings and projections, as previously described.

FIG. 18-A illustrates two-plate interposer assembly 700 for forming continuous electrical circuit paths between opposed pads 702 on upper substrate 704 and lower substrate 706. As illustrated in FIG. 18-B, the pads are arranged in a rectangular high-density land grid array with 10 rows each having 30 pads with a total of 300 closely spaced pads in the array. The assembly may be mounted between misaligned substrates. The assembly also permits lateral shifting of the substrates after mounting without transmitting forces between the substrates.

Assembly 700 includes like top and bottom plates 708, 710 stacked on top of each other. The plates are rectangular, have insulating bodies 712, sides 714 and ends 716 and a uniform thickness between flat, parallel top and bottom surfaces. A large number of closely-spaced, like contact slots or passages 718 extend between the top and bottom surfaces of each plate.

Two slotted openings 720 extend vertically through the ends 716 of each plate. Each opening 720 includes a cylindrical passage or hole 722 with slots 724 to either side of the passage. The slots extend toward plate sides 714. Retention rings 726 extend into each passage 722.

Four alignment and spacing pins or posts 728 are fitted in the four aligned passages 722 at the ends of two plates 712. Each pin includes a central stand off or collar 730 located in space 731 between the plates and cylindrical portions 732 of the pins extending from the collar along passages 722 to ends located at the outer surfaces of the plates. Retention grooves 734 extend around the pin portions 732 and receive rings 726. During insertion of the pins into passages 722, the portions of the plates between slots 724 and plate ends 716 flex outwardly until rings 726 fit in grooves 734. The pin portions 732 have a smaller diameter than passages 722 and are loose in the passages to permit limited lateral motion or shifting of the upper plate relative to the lower plate. Rings 726 fit in groove 734 to secure the plates together in assembly 700.

The alignment pins 728 permit relative shifting of the plates in any desired direction. This shifting facilitates mounting of each plate 708, 710 on a substrate so that the contacts in the plates extending outwardly from the plates to engage contact pads on the substrates without the necessity of assuring that the contact pads on the two substrates are in exact alignment. Pins 728 and other disclosed pins may be made from stainless steel.

A one-piece, stamp formed contact 736 is fitted in each vertically aligned pair of contact passages 718 in the assembly 700. As shown in FIG. 18-G, contact 736 is elongated and extends between opposed contact noses 738. The contact is formed from a flat strip metal pre-form shown in FIG. 18-H. The strip contact 736 includes like upper and lower halves 740 and 742 located to either side of the center of central vertical beam 744. Each contact half includes a vertical beam 746 above or below beam 744 on the same side of the contact as beam 744, and vertical beams 748 on the opposite side of the contact between beams 744 and 746. Beams 744 and 748 are joined by angled, full width transverse beams 750. Beams 746 and 748 are joined by angled, full passage width transverse beams 752. Noses 738 are connected to the outer ends of beams 746 by angled, half width transverse beams 754. Rounded contact ends 756 are connected to noses 738 by angled, half passage width arms 758.

FIG. 18-H illustrates a flat stamp-formed strip metal pre-form 760 for contact 736. Pre-form 760 is a strip of uniform thickness metal symmetrical to either side of centerline 762. Contact 736 is formed by bending the flat pre-form strip to the shape of the contact. Compare FIGS. 18-G and 18-H. The pre-form 760 is symmetrical to either side of pre-form longitudinal centerline or axis 764, with the exception of end portions 766.

In the pre-form, each portion 766 includes a strip 768 having an edge on centerline 764 with a flat, 90-degree tab 770 joined to the strip edge at the centerline and extending from the centerline away from the strip to tab point 771. The tabs 770 are located at the contact noses 738 on formed contacts 736. As illustrated in FIG. 18-G, the tabs are bent upwardly from the contact noses so that the tips 772 on the upper sides of the tab points 771 face upwardly to engage pads 702 on substrates 704 and 706. The tips 772 on tabs 770 are specially stamp formed and have a very small double curvature Hertzian shape for forming small, high-pressure and reliable electrical connections with pads, as disclosed below.

Interposer assembly 700 is mounted between substrates 704 and 706 by positioning plate 710 in alignment collar 774 on substrate 706 below substrate 704. The substrates are then brought together to position top plate 708 in collar 774 on substrate 704. The two plates 708, 710 are free to shift laterally along the open lateral shift interface 775 between the substrates by limited rotation of pins 732 in pin holes 722, as previously described, to permit mounting of the interposer assembly between misaligned substrates. A conventional clamp assembly (not illustrated) clamps the substrates against each other to compress the contacts 736 and form high-pressure electrical connections between the small rounded tips 772 at each contact end and associated pads on the substrates. The substrates are moved together sufficiently to form electrical connections without moving the substrates and plates into physical contact with each other. Alternatively, the substrates may be moved into engagement with the plates. Compressing the contacts elastically bends the contact beams to provide high-contact force at the small area tips and assure very high contact pressure. Stressing of the contacts may move the tips short distances along the pads to assist in forming low resistance electrical connections. This movement is not sufficient to move the tips out of engagement from the pads, despite lateral shifting of the plates 708 and 710. Lateral shifting of the plates may move the contact tips slight distances along the pads without moving the tips off of the pads.

Single piece strip metal contacts 736 extend between the top and bottom of the assembly and across the lateral shift interface 775 to provide continuous metal electrical circuit paths between opposed pairs of pads on the substrates.

The contact tips 772 on the top of bent up tab 770 are located very close to or on the centerline 764 for contact 736. The formed contacts 736 are fitted in aligned passages 718 in the top and bottom plates 708 and 710 as shown in FIG. 18-F. The contact beams are adjacent the narrow vertical passage sidewalls and the contact ends are adjacent opposite narrow vertical passage sidewalls. The wide passage sidewalls are slightly wider than the width of the contact to prevent binding. When the contact is uncompressed in the passage, beams 746 and end 756 engage the passage sidewalls and, in cooperation with angled surfaces in the passages, retain the contacts in the passages.

Bent up lateral tabs 770 are located at each contact nose 738. The tabs are bent above the noses so that the tips 772 on the upper sides of the tabs are above the noses and engage the substrate pads 702. The tips have a very small area and are Hertzian.

Rectangular alignment collars 774 are mounted on substrates 702 and 706 to align the top and bottom plates 708 and 710 on the substrates, as previously described. The collars include alignment keys 776 which extend into recesses 778 in plates 714 to ensure proper orientation of the plates in the collars.

During mounting of the interposer assembly on substrates 704 and 706, the contact tips 772 on tabs 770 on each end of the contacts engage pads on the substrates. Collapse of the contact 736 in passages 718 elastically stresses the contact beams to provide high, compliant contact forces at the tips and to wipe the tips a short distance along the pads. The wipe, small contact area and high contact pressure assure reliable electrical connections are established between the contacts and the pads and reliable interconnections between adjacent aligned pads on the substrates.

FIG. 18-I illustrates that tab 770 has straight edges 780 intersecting at an angle of 90° at tip 772 on the upper surface of the tab. The surfaces 780 intersect at 90 degrees in order to form the small, double curvature Hertzian tip 772. The shape of edges 780 of the tab may be straight, or may be curved, as illustrated in FIG. 19-C. The edges preferably intersect at the tip at 90°.

The continuous electrical circuit paths used in the disclosed interposer assemblies are formed from from strip metal contacts, either a single continuous strip metal contact that extends past a lateral shift interface or a number of strip metal contacts with pressure connections between adjacent contacts. Other types of conductors may be used for forming connections between the contact surfaces at the ends of the circuit paths. For instance, single or multi-strand wire conductors may be used.

The contact tip 772 and methods for forming the tip will now be described.

Contact 736 is formed by progressively stamping flat metal strip stock. FIGS. 19-A, 19-B and 19-C illustrate forming two small double curvature contact tips 782 on opposite sides of a stamped opening in strip metal stock. Contact tips 772 may be formed by the method of forming tips 782 shown in these Figures.

FIG. 19-A illustrates progressively stamping thin sheet metal strip 784 to form two tips 782. First, an elongated opening 786 is stamped through the strip with a curved end 788 being formed.

As illustrated in FIG. 19-B, during the stamping operation a strip portion 790 is supported by an anvil and a strip portion 792 is forced downwardly by tooling to shear apart the portions and form sheared edges 794 and 796 extending across the thickness of the strip. The shearing forms a rounded shear corner 798 at each edge 794, 796 and a sharp drag corner 800 at each edge 794 and 796. In F*igure* 19-A, metal is stamped from opening 786 to form a rounded shear corner 798 on the side of strip 786 facing the viewer.

Small area double curvature contact tips 772 are formed by punching a second opening 802 in strip 784 in the same direction opening 786 was punched. The rounded upper end of the punch tooling forming opening 802 intersects the curved lower portion of opening 786 at 900 at two tip locations. The rounded shear corner 804 at the edge of opening 802 is also on the side of strip 784 facing the viewer.

The two shear edges and two rounded shear corners 798 and 804 intersect at 90° at contact points 771. See FIG. 19-C. The intersection of the two very small rounded and perpendicular shear corners at 90° forms very small double curvature contact tips 806. Each tip 806 is located inwardly from the point. See FIGS. 19-D, 19-E 19-F and 19-G. Stamping of the two openings 786, 802 also forms two tabs 808, like tabs 770, extending from the tips to the strip. Tabs 808 may be bent up relative to strip 784 to position the contact tips 806 above the strip for contact engagement with contact pads.

After stamp forming and bending of contacts 736 with small double curvature contact tips 772 on bent up tabs 770, the contacts are suitably plated prior to loading into plates 704 and 708.

A single contact tip 772 is provided at each end of contact 736. Each tip is located on one side of nose 738. The contacts 736 are sufficiently long from nose to nose to assure that the slight off center forces applied at the tips do not bias the contact against passage sidewalls sufficiently to reduce contact pressure. Location of the tips 772 very close to axis 764 reduces skewing of the contacts when compressed and possible frictional engagement with sides of the passages in the plates.

Illustrated assembly 700 may have a length of about 27 mm and a width of about 9 mm and hold a 10×30 array of contacts 736 with the contact tips 772 spaced apart from each other at a 0.8 mm square pitch. The total height of assembly 10 may be 6.25 mm with each plate 12 having a thickness of 2.9 mm. Contacts 736 may be stamp-formed from the strip stock having a thickness 0.043 mm with passages 718 having a maximum width, between narrow sidewalls of 0.95 mm and a minimum width between the wide sidewalls of about 0.83 mm. The small, double curvature contact tips 772 are Hertzian and form small, high pressure, electrical connections with pads 702. As illustrated in FIG. 18-G, this area is considerably smaller than the exposed area of nose 738 with resultant increased contact pressure at the tip/pad connection.

Strip contacts 736 have very small Hertzian contact tips for engaging substrate pads. Tips of this type may be provided on the contacts used in all disclosed interposer assemblies. Preferably, the contact tips should be located adjacent or on the longitudinal axis of the contact to reduce skewing of the contact in a contact passage.

The invention claimed is:

1. An interposer assembly for establishing electrical connections between pads on two opposed substrates, the assembly comprising first and second stacked plates to be positioned between the substrates; each plate formed from a dielectric material and comprising a first side facing one substrate and a second side facing the other plate; a first lateral shift interface between the second sides of the plates; and a plurality of continuous electrical circuit paths, each circuit path comprising a first contact surface on the first side of the first plate for engaging a pad on one substrate, a second contact surface on the first side of the second plate for engaging a pad on the other substrate, and a conductor joining the contact surfaces, the conductor extending through the plates and across the lateral shift interface, wherein when the assembly is positioned between the substrates the assembly maintains electrical connections between substrate pads over a range of lateral shifting of the plates at the interface.

2. The assembly as in claim 1 wherein each circuit path comprises a single conductive member extending between said contact surfaces.

3. The assembly as in claim 1, wherein said lateral shift interface comprises a sliding lateral shift interface.

4. The assembly as in claim 1, comprising an alignment collar for each plate, said collars adapted for mounting the plates on the substrates.

5. The assembly as in claim 1 wherein the second sides of the plates define the lateral shift interface.

6. The assembly as in claim 1 wherein said lateral shift interface permits movement of said plates in any direction along the interface.

7. The assembly as in claim 1 comprising a third plate positioned between the first and second plates; said circuit paths extending through said third plate.

8. The assembly as in claim 7, comprising a second lateral shift interface.

9. The assembly as in claim 1, wherein said lateral shift interface comprises an open lateral shift interface.

10. The assembly as in claim 9, comprising a spacer separating the plates.

11. The assembly as in claim 1, wherein each circuit path comprises a first end portion including a first bent up tab having shear formed edges intersecting at a first double curvature tip.

12. The assembly as in claim 11, wherein the tip is located at or adjacent the longitudinal axis of the circuit path.

13. The assembly as in claim 11, wherein each circuit path comprises a second end portion including a second bent up tab having shear formed edges intersecting at a second double curvature tip.

14. The assembly as in claim 1 wherein each circuit path comprises a plurality of conductive members and a pressure connection between two adjacent members.

15. The assembly as in claim 14, wherein in each circuit path said pressure connection is located at said lateral shift interface.

16. The assembly as in claim 15, wherein said pad-engaging contacts comprise contact noses.

17. The assembly as in claim 1, wherein said conductors comprise metal strips.

18. The assembly as in claim 17, wherein each contact surface comprises a bent up tab.

19. The assembly as in claim 18, wherein each tab is located on or adjacent the longitudinal axis of a strip.

20. The assembly as in claim 19, wherein each contact surface comprises a double curvature tip at the intersection of two shear-formed edge corners.

21. The assembly as in claim 1, comprising a first opening in the first plate, a second opening in the second plate and an alignment member in said openings, one opening larger than the member to permit movement of the plates along the lateral shift interface.

22. The assembly as in claim 21, wherein said alignment member comprises a pin and said openings comprise holes.

23. The assembly as in claim 22, comprising a collar extending inwardly from each hole, said pin extending through the collars.

24. The assembly as in claim 22, comprising projections extending outwardly from said pin for retaining the pin in the holes.

25. The assembly as in claim 24, wherein said pin has ends located within said plates.

26. The assembly as in claim 24, wherein said pin has ends extending outwardly of said plates.

27. The method of forming conductive paths between pads on opposed substrates comprising the steps of:

a) positioning an interposer assembly between the opposed substrates to locate first contacts on one side of the interposer assembly adjacent pads on one substrate and to locate second contacts on another side of the interposer assembly adjacent pads on the other substrate, the interposer assembly having circuit paths extending between first and second contacts;

b) laterally shifting the first and second sides of the interposer assembly along a lateral shift interface located between said sides to align the first contacts with the pads on one substrate and to align the second contacts with the pads on the other substrate; and c) forming first electrical connections between the first contacts and the pads on said one substrate and forming second electrical connections between the second contacts and the pads on the other substrate to establish the conductive paths.

28. The method of claim 27, including the step of:

d) laterally shifting the first and second contacts along a second lateral shift interface.

29. The method of claim 27, including the step of:

d) shifting the first and second sides of the interposer assembly in any direction along the lateral shift interface.

30. The method of claim 27, including the step of:

d) maintaining a pressure connection in each circuit path at the interface during lateral shifting of the sides of the interposer assembly.

31. The method of claim 27, wherein the interposer assembly includes continuous metal circuit paths extending between the first and second contacts, including the step of:

d) flexing the metal circuit paths during lateral shifting of the sides of the interposer assembly.

32. An interposer assembly for forming electrical connections between pads on upper and lower members, the assembly comprising a top insulating body, a bottom insulating body, a first lateral shift interface between the bodies, and a plurality of continuous electrical circuit paths, each path extending through the top body, across the lateral shift interface and through the bottom body, each path including a contact surface on the top body and a contact surface on the bottom body, wherein the contact surfaces on the top body make electrical connections with pads on an upper member and the contact surfaces on the bottom body make electrical connections with pads on a lower member independent of alignment of the members and the assembly maintains the continuous electrical circuit paths between the contact surfaces over a range of lateral shifting of the bodies at the interface.

33. The interposer assembly as in claim 32, wherein each continuous electrical circuit path comprises a strip metal contact.

34. The interposer assembly as in claim 33, wherein each strip metal contact extends across the lateral shift interface.

35. The interposer assembly as in claim 32, including a shear-formed double curvature contact tip at an edge of one contact surface.

36. The interposer assembly as in claim 32, wherein said lateral shift interface is a sliding interface.

37. The interposer assembly as in claim 32, wherein the lateral shift interface is an open interface, and a spacer in the interface.

38. The interposer assembly as in claim 32, comprising a first alignment collar surrounding said top body, a second alignment collar surrounding said bottom body, a first spring clip between said top plate and said first alignment collar, and a second spring clip between said bottom plate and said bottom alignment collar, each spring clip biasing a body against a collar.

39. The assembly as in claim 32 wherein said lateral shift interface permits movement of said members in any direction along the interface.

40. The interposer assembly as in claim 32, wherein each continuous electrical circuit path includes a pressure electrical connection.

41. The interposer assembly as in claim 40, wherein said pressure electrical connections are located at said lateral shift interface.

42. The interposer assembly as in claim 32, including a shift limiting member mounted on said bodies and extending across the interface, said shift limiting member moveable relative to at least one body to limit lateral shift of the bodies at the interface.

43. The interposer assembly as in claim 42, wherein said shift limiting member comprises a pin extending across the interface, and a recess in each body, said pin extending into said recesses.

44. The interposer assembly as in claim 43, wherein the pin is rotatable in said recesses.

45. The interposer assembly as in claim 43, wherein said pin is fixedly mounted in one body and moveable relative to the other body.

46. The interposer assembly as in claim 32, wherein said insulating bodies comprise a top plate and a bottom plate, and a central plate located between said top plate and said bottom plate, said first lateral shift interface between said top plate and said central plate, and a second lateral shift interface between said central plate and said bottom plate.

47. The interposer assembly as in claim 46, wherein each electrical circuit path comprises a resilient strip contact in each of the top and bottom plates, and each strip contact comprises a first contact surface engaging a pad on one member and a second contact surface engaging a pad on the central plate.

48. The interposer assembly as in claim 46, wherein each electrical circuit path extends across said second lateral shift interface and a pressure electrical connection at each lateral shift interface.

49. The interposer assembly as in claim 48, wherein said central plate comprises a plurality of pads at each interface and electrical connections between opposed pairs of said such pads.

50. The method of maintaining electrical connections between pads on opposed substrates comprising the steps of:

a) providing an interposer assembly having first contacts on a first side, second contacts on a second side, continuous electrical circuit paths between contacts on the first and second sides, and a lateral shift interface between the sides;

b) mounting the interposer assembly on opposed substrates with the first contacts engaging pads on one substrate and the second contacts engaging pads on the other substrate to form continuous electrical circuit paths between the pads;

c) applying a lateral force to the substrates;

d) laterally shifting each substrate and its associated side of the interposer assembly about the lateral shift interface between the sides of the interposer assembly while maintaining the continuous electrical circuit paths.

51. The method of claim 50 including the step of:

e) moving the first and second sides of the interposer assembly along a closed lateral shift interface.

52. The method of claim 50 including the step of:

e) moving the sides of the interposer assembly along an open lateral shift interface while maintaining the height of the assembly.

* * * * *